US012631029B2

(12) United States Patent
Weng et al.

(10) Patent No.: US 12,631,029 B2
(45) Date of Patent: May 19, 2026

(54) SHED

(71) Applicant: JINGNING MEIGE TECHNOLOGY SERVICE CO., LTD., Lishui (CN)

(72) Inventors: Dawei Weng, Lishui (CN); Haoliang Hu, Lishui (CN); Yifan Zhai, Lishui (CN)

(73) Assignee: JINGNING MEIGE TECHNOLOGY SERVICE CO., LTD., Lishui (CN)

( * ) Notice: Subject to any disclaimer, the term of this patent is extended or adjusted under 35 U.S.C. 154(b) by 307 days.

(21) Appl. No.: 18/585,105

(22) Filed: Feb. 23, 2024

(65) Prior Publication Data

US 2025/0188749 A1 Jun. 12, 2025

(30) Foreign Application Priority Data

Dec. 12, 2023 (CN) ..... 202311695699.3

(51) Int. Cl.
*E04F 13/08* (2006.01)

(52) U.S. Cl.
CPC ..... *E04F 13/0894* (2013.01)

(58) Field of Classification Search
CPC ..... E04C 2/40; E04C 2/46; E04C 2/30; E04C 2/526; E04B 2/00; E04B 1/612; E04B 1/6125; E04B 1/343; E04B 1/34321; E04B 1/61; E04B 7/02; E04B 2001/6195; E04F 15/02; E04F 13/0894; E04H 1/1205
See application file for complete search history.

(56) References Cited

U.S. PATENT DOCUMENTS 6,668,514 B2 * 12/2003 Skov ..... E04H 1/1205 52/592.1
6,966,449 B2 * 11/2005 Williams ..... B65D 19/18 206/509
7,003,863 B2 * 2/2006 Skov ..... A47F 5/0815 52/36.5
8,800,216 B2 * 8/2014 Phillips ..... E04H 1/1205 52/36.2
8,978,319 B2 * 3/2015 Patino ..... E04H 1/02 52/745.02
9,328,503 B1 * 5/2016 Patino ..... E04C 2/52
9,598,856 B2 * 3/2017 Schulte ..... A47B 47/042
(Continued)

FOREIGN PATENT DOCUMENTS

CN 218438516 U * 2/2023
CN 116104335 A 5/2023

*Primary Examiner* — Rodney Mintz
(74) *Attorney, Agent, or Firm* — Bayramoglu Law Offices LLC

(57) ABSTRACT

A shed includes top plates, a support frame, and multiple wallboards, where the wallboards each are provided with a first mounting portion; an end of the top plate is provided with a first mounting groove; the first mounting portion is fit with the first mounting groove to connect the top plate to the wallboard; the top plates include multiple first top plates and multiple second top plates; the first top plates are connected to the second top plates; the support frame includes a first support rod; the first support rod is provided at a junction between the first top plate and the second top plate; a connecting plate is provided at a junction between each two adjacent wallboards; a first end of the connecting plate is connected to a first end of the first support rod; and a bottom of the wallboard is connected to a floor.

8 Claims, 41 Drawing Sheets

(56) References Cited

U.S. PATENT DOCUMENTS

| | | | | |
|---|---|---|---|---|
| 10,626,622 | B2 * | 4/2020 | Huang | E04F 15/02 |
| 12,304,692 | B1 * | 5/2025 | Zhai | B65D 11/20 |
| 12,480,303 | B2 * | 11/2025 | Jiang | E04B 1/6137 |
| 12,486,659 | B2 * | 12/2025 | Jiang | E04B 1/6137 |
| 2002/0170242 | A1 * | 11/2002 | Skov | A47F 5/0815 52/79.1 |
| 2002/0174532 | A1 * | 11/2002 | Skov | E04B 1/12 29/453 |
| 2004/0129699 | A1 * | 7/2004 | Williams | B65D 11/1873 220/4.31 |
| 2007/0175108 | A1 * | 8/2007 | Stein | E04B 1/34321 52/79.5 |
| 2008/0216426 | A1 * | 9/2008 | Bunker | E04B 1/34315 52/285.3 |
| 2012/0005968 | A1 * | 1/2012 | Patino | E04H 1/02 52/745.13 |
| 2012/0227349 | A1 * | 9/2012 | Phillips | E04H 1/1205 52/588.1 |
| 2015/0368896 | A1 * | 12/2015 | Schulte | F16B 12/125 403/364 |
| 2019/0234081 | A1 * | 8/2019 | Huang | E04F 15/02038 |
| 2024/0035271 | A1 * | 2/2024 | Jiang | E04B 1/34384 |
| 2024/0035272 | A1 * | 2/2024 | Jiang | E04B 1/6162 |
| 2024/0254768 | A1 * | 8/2024 | Boo | E04C 2/10 |
| 2025/0188740 | A1 * | 6/2025 | Weng | E04C 2/40 |

* cited by examiner

A

D

E

F

G

H

J

K

N

0

P

Q

R

SHED

CROSS REFERENCE TO RELATED APPLICATIONS

This application is based upon and claims foreign priority to Chinese Patent Application No. 202311695699.3, filed on Dec. 12, 2023, the entire contents of which are incorporated herein by reference.

TECHNICAL FIELD

The present disclosure relates to the technical field of outdoor sheds, and in particular to a shed.

BACKGROUND

Sheds are generally set up in outdoor places such as gardens, mainly used to store tools or for people to rest, drink water, and enjoy the cool in their spare time.

Chinese patent application CN202310228772X provides a shed, including a framework and a wallboard provided outside the framework. The framework includes multiple spaced support frames and connecting rods connected between the support frames. The support frame includes a pair of interconnected top rods and support rods provided at outer ends of the top rods. The connecting rods, top rods, and support rods are provided with clamping grooves for clamping the wallboard. The wallboard includes a door plate provided on the support frame, a top plate provided between the top rod and the connecting rod, and a side plate provided between the support rod and the connecting rod. The connecting rod is provided between ends of the top rod and the support rod for connecting the spaced support frames. The connecting rods include upper connecting rods located at tops of the top rods, middle connecting rods each located at a junction between the top rod and the support rod, and lower connecting rods located at bottoms of the support rods. The top plate is set up through the top rods and the connecting rods, which requires the setup of the top rods and the connecting rods before the setup of the top plate, resulting in a large number of components and complex construction for the shed.

SUMMARY

In response to the shortcomings in the prior art, the present disclosure provides a shed featuring reliable connection and convenient mounting.

In order to solve the above technical problem, the present disclosure adopts the following technical solution. A shed includes top plates, a support frame, and multiple wallboards, where the wallboards each are provided with a first mounting portion; an end of the top plate is provided with a first mounting groove; the first mounting portion is fit with the first mounting groove to connect the top plate to the wallboard; the top plates include multiple first top plates and multiple second top plates; the first top plates are connected to the second top plates; the support frame includes a first support rod; the first support rod is provided at a junction between the first top plate and the second top plate; a connecting plate is provided at a junction between each two adjacent wallboards; and a first end of the connecting plate is connected to a first end of the first support rod.

In a preferred implementation, a bottom of the wallboard is connected to a floor; the floor is provided with a first limit groove; and a second end of the connecting plate is provided in the first limit groove.

In a preferred implementation, the first mounting portion includes at least a first mounting surface and a second mounting surface; the first mounting groove includes at least a first contact surface and a second contact surface; and after the top plate is connected to the wallboard, the first contact surface is at least partially adhered to the first mounting surface, and the second contact surface is at least partially adhered to the second mounting surface, the first contact surface is close to an edge of the top plate, and an area of contact between the first mounting surface and the first contact surface is greater than an area of contact between the second mounting surface and the second contact surface.

In a preferred implementation, the first mounting groove is an elongated groove; the first contact surface and the second contact surface are provided on an inner wall of the first mounting groove; the first contact surface and the second contact surface form two side walls of the first mounting groove, respectively; and a width of the first contact surface is greater than a width of the second contact surface.

In a preferred implementation, the first mounting portion is provided at an upper end of the wallboard and horizontally provided along the upper end of the wallboard; and a width of the first mounting surface is greater than a width of the second mounting surface.

In a preferred implementation, the first mounting portion further includes a third mounting surface; the third mounting surface is provided between the first mounting surface and the second mounting surface; the first mounting groove further includes a third contact surface; the third contact surface is provided between the first contact surface and the second contact surface; and after the top plate and the wallboard are connected, the third contact surface is at least partially adhered to the third mounting surface.

In a preferred implementation, an angle between the first contact surface and the third contact surface is greater than 90° but less than 180°; and an angle between the second contact surface and the third contact surface is less than or equal to 90°.

In a preferred implementation, the first mounting portion further includes a fourth mounting surface; the fourth mounting surface is provided between the second mounting surface and the third mounting surface; a width of the third contact surface is greater than a width of the third mounting surface; after the top plate and the wallboard are connected, the fourth mounting surface is located below a junction between the second contact surface and the third contact surface; and there is a gap between the fourth mounting surface and the junction.

In a preferred implementation, a working hole is provided at an upper side of the wallboard; and one end of a bolt passes through the working hole and is connected to the top plate.

In a preferred implementation, an inner side of the wallboard is provided with a first recess; the first recess is provided at the upper side of the wallboard and extends to the second mounting surface; and the working hole is located in the first recess.

In a preferred implementation, an outer side of the wallboard is provided with a second recess; the second recess is provided at the upper side of the wallboard; the second recess corresponds to the first recess in terms of position; and the working hole is located in the second recess.

In a preferred implementation, the support frame further includes a second support rod; a second end of the first support rod is connected to a first end of the second support rod; after the first support rod and the second support rod are connected, an angle between the first support rod and the second support rod is greater than 90° but less than 180°; the support frame further includes a connecting rod; and the connecting rod includes one end connected to the first support rod and the other end connected to the second support rod.

In a preferred implementation, the first support rod and the second support rod each are provided with a first flow channel; and the first flow channel is located directly below a junction between two adjacent top plates.

In a preferred implementation, the connecting rod is provided with a mounting bracket; and the first support rod is connected to the second support rod through the mounting bracket.

In a preferred implementation, a bottom of the mounting bracket is provided in a middle of the connecting rod and connected to the connecting rod by a bolt; an upper part of the mounting bracket is provided with a first working groove and a second working groove; the second end of the first support rod is provided in the first working groove; and the first end of the second support rod is provided in the second working groove.

In a preferred implementation, the first support rod includes a first bottom plate; two sides of the first bottom plate are respectively provided with first side plates; the first side plates are connected to first wing plates; the first working groove is a U-shaped groove, including a first bottom wall and first side walls provided at two sides of the first bottom wall; and after the first support rod is connected to the first working groove, the first bottom plate is at least partially in contact with the first bottom wall, and the first side plate is at least partially in contact with the first side wall.

In a preferred implementation, the first flow channel on the first support rod is formed by the first bottom plate and the first side plates at two sides.

In a preferred implementation, the second support rod includes a second bottom plate; two sides of the second bottom plate are respectively provided with second side plates; the second side plates are connected to second wing plates; the second working groove is a U-shaped groove, including a second bottom wall and second side walls provided at two sides of the second bottom wall; and after the second support rod is connected to the second working groove, the second bottom plate is at least partially in contact with the second bottom wall, and the second side plate is at least partially in contact with the second side wall.

In a preferred implementation, the first flow channel on the second support rod is formed by the second bottom plate and the second side plates at two sides.

In a preferred implementation, avoidance grooves are provided at two sides of the wallboard; the avoidance grooves are located at the upper end of the wallboard; and the first support rod or the second support rod at least partially passes through the avoidance groove.

In a preferred implementation, the mounting bracket is provided with baffles; a first clamping groove is formed between the baffle and the first working groove; an end portion of an end of the first support rod connected to the mounting bracket is located in the first clamping groove; a second clamping groove is formed between the baffle and the second working groove; and an end portion of an end of the second support rod connected to the mounting bracket is located in the second clamping groove.

In a preferred implementation, recess structures are respectively provided at two sides of the top plate; an outer side of each of the recess structures is provided with a protrusion portion; and after the top plate is connected to the first support rod, the protrusion portion is located at an inner side of the first side plate, and the first wing plate is located in the recess structure.

In a preferred implementation, the connecting plate includes a first vertical plate, a second vertical plate, and a third vertical plate; the third vertical plate is provided between the first vertical plate and the second vertical plate; and the first vertical plate is connected to the second vertical plate through the third vertical plate.

In a preferred implementation, the third vertical plate includes two third wing plates and one mounting plate; the two third wing plates are respectively located at two sides of the mounting plate; one third wing plate is connected to the first vertical plate, and the other third wing plate is connected to the second vertical plate; and the two third wing plates and the mounting plate form a second flow channel.

In a preferred implementation, an upper end of the mounting plate is provided with a second mounting portion; the second mounting portion is connected to the first bottom plate or the second bottom plate; a lower end of the mounting plate is provided with a third mounting portion; and the third mounting portion is inserted into the first limit groove.

In a preferred implementation, one end of the bottom of the wallboard is provided with a first positioning protrusion; the floor is provided with a first positioning groove; the first positioning groove is fit with the first positioning protrusion to limit the one end of the bottom of the wallboard to the floor; the first positioning groove is an arc-shaped groove; and the first positioning protrusion is rotatable in the first positioning groove.

In a preferred implementation, the first positioning groove is located at an outer side of the first limit groove.

In a preferred implementation, the first positioning groove includes a first mounting point and a second mounting point; the bottom of the wallboard is provided with a second positioning protrusion; the second positioning protrusion is provided at an end far away from the first positioning protrusion; and if any two adjacent wallboards are defined as a first plate and a second plate, respectively, then after the first plate and the second plate are connected to the floor, the first positioning protrusion of the first plate is located at the first mounting point of a previous first positioning groove, the second positioning protrusion of the first plate is located at the second mounting point of a subsequent first positioning groove, the first positioning protrusion of the second plate and the second positioning protrusion of the first plate are located in the same first positioning groove, and the first positioning protrusion of the second plate is located at the first mounting point of the first positioning groove.

In a preferred implementation, a height of the first positioning protrusion is defined as H1, and a height of the second positioning protrusion is defined as H2, $H2<H1$.

In a preferred implementation, the wallboard includes multiple first support plates and multiple second support plates; the second support plates are located at corners of the shed; and the first support plate is connected to an adjacent first support plate or second support plate.

In a preferred implementation, the second support plates each include a first working plate and a second working plate; a side of the first working plate is connected to a side of the second working plate; and after the first working plate and the second working plate are connected, an angle between the first working plate and the second working plate is greater than 0° but less than 180°.

In a preferred implementation, two sides of the first support plate are provided with first clamping connectors and first connecting grooves, and two sides of the second support plate are provided with second clamping connectors and second connecting grooves; the first clamping connectors are fit with the second connecting grooves, and the second clamping connectors are fit with the first connecting grooves, thereby connecting the first support plate to the second support plate; and if any two adjacent first support plates are defined as a first plate and a second plate, respectively, then the first clamping connectors of the first plate are fit with the first connecting grooves of the second plate, and the first connecting grooves of the first plate are fit with the first clamping connectors of the second plate, thereby connecting the two adjacent first support plates.

In a preferred implementation, the two sides of the first support plate are provided with first protrusions; the first protrusions are spaced from the first connecting grooves; the first clamping connector is provided on the first protrusion; the two sides of the second support plate are provided with second protrusions; the second protrusions are spaced from the second connecting grooves; the second clamping connector is provided on the second protrusion; the first protrusion has a length smaller than a length of the first connecting groove and a length of the second connecting groove; and the second protrusion has a length smaller than the length of the first connecting groove and the length of the second connecting groove.

In a preferred implementation, the floor is provided with multiple first limit protrusions; an inner wall of the wallboard is provided with multiple third recesses; the third recesses are located at the bottom of the wallboard; and the first limit protrusions are fit with the third recesses to connect the wallboard to the floor.

In a preferred implementation, the floor is provided with a step surface; the first limit protrusion and the first positioning groove are provided on the step surface; and after the wallboard is connected to the floor, the bottom of the wallboard is located on the step surface.

In a preferred implementation, the step surface is provided with multiple protrusions, and the bottom of the wallboard is provided with multiple first grooves; the protrusions correspond one-to-one with the first grooves in terms of quantity and position; and after the wallboard is connected to the floor, the protrusions are located in the first grooves.

In a preferred implementation, the protrusions are raised bars or ridges; and the protrusions each are provided with a first slope.

In a preferred implementation, a second slope is provided at an edge of the step surface.

Compared with the prior art, in the present disclosure, the wallboard is provided with a first mounting portion, and an end of the top plate is provided with a first mounting groove. The top plate is clamped into the wallboard through the first mounting groove, without the need for other components, making it convenient for assembly and disassembly. The first support rod is provided at a junction between the first top plate and the second top plate to strengthen connection strength between the two adjacent top plates. A connecting plate is provided at a junction between each two adjacent wallboards, and a first end of the connecting plate is connected to a first end of the first support rod. On the one hand, the connecting plate strengthens the connection strength between the two adjacent wallboards. On the other hand, the connecting plate and the wallboard play a supporting role, allowing the top plate and the wallboard of the shed to bear a significant load.

BRIEF DESCRIPTION OF THE DRAWINGS

The present disclosure will be further described in detail below with reference to the drawings and preferred embodiments. However, those skilled in the art should understand that these drawings are drawn only for the purpose of explaining the preferred embodiments, and therefore should not be construed as a limitation to the scope of the present disclosure. In addition, unless otherwise specified, the drawings are only intended to conceptually represent the composition or configuration of the described objects and may include exaggerated displays, and the drawings are not necessarily drawn to scale.

REFERENCE NUMERALS

Figure 1:
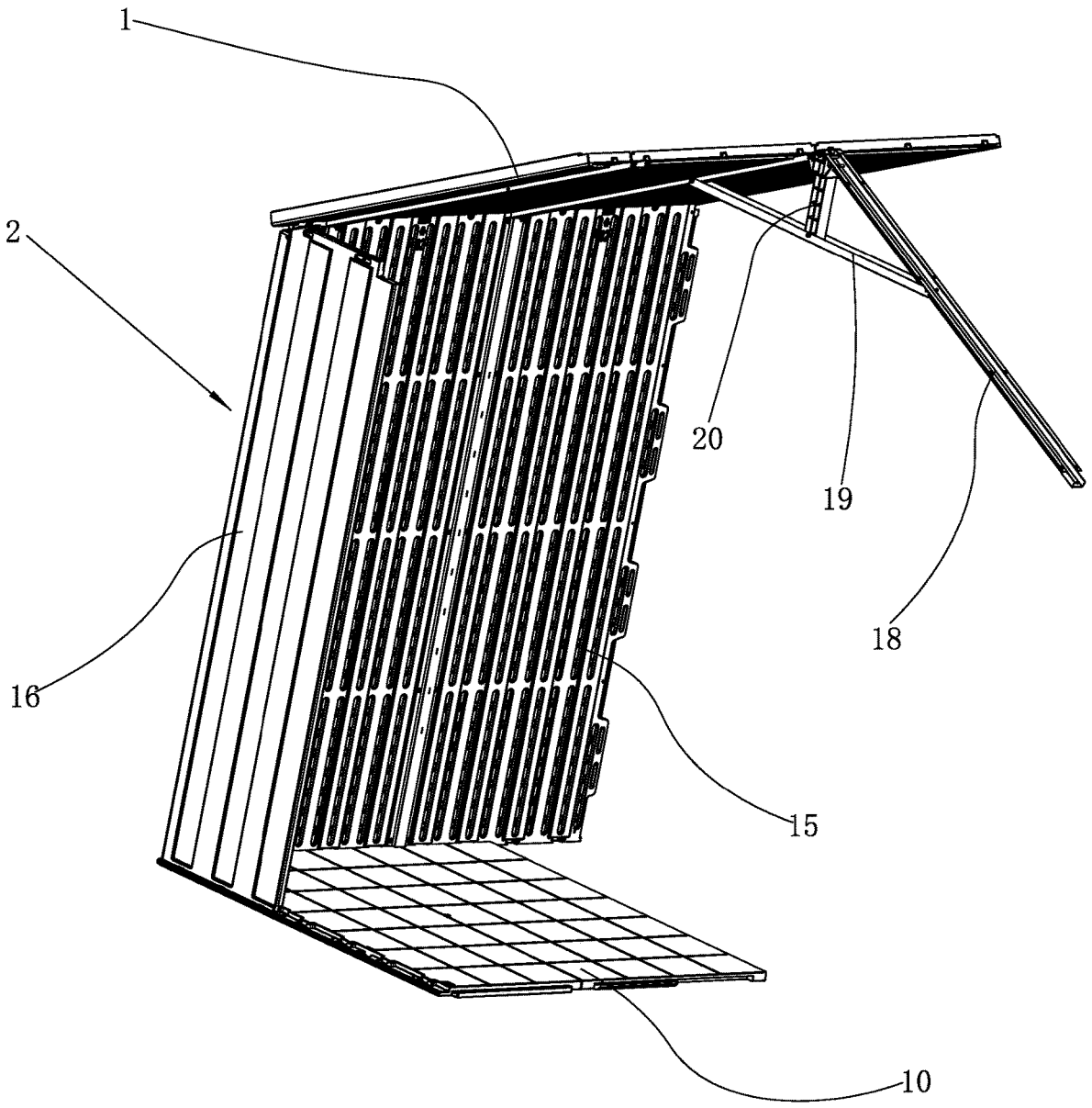
FIG. 1 is a first structural diagram of a shed according to the present disclosure.
Figure 2:
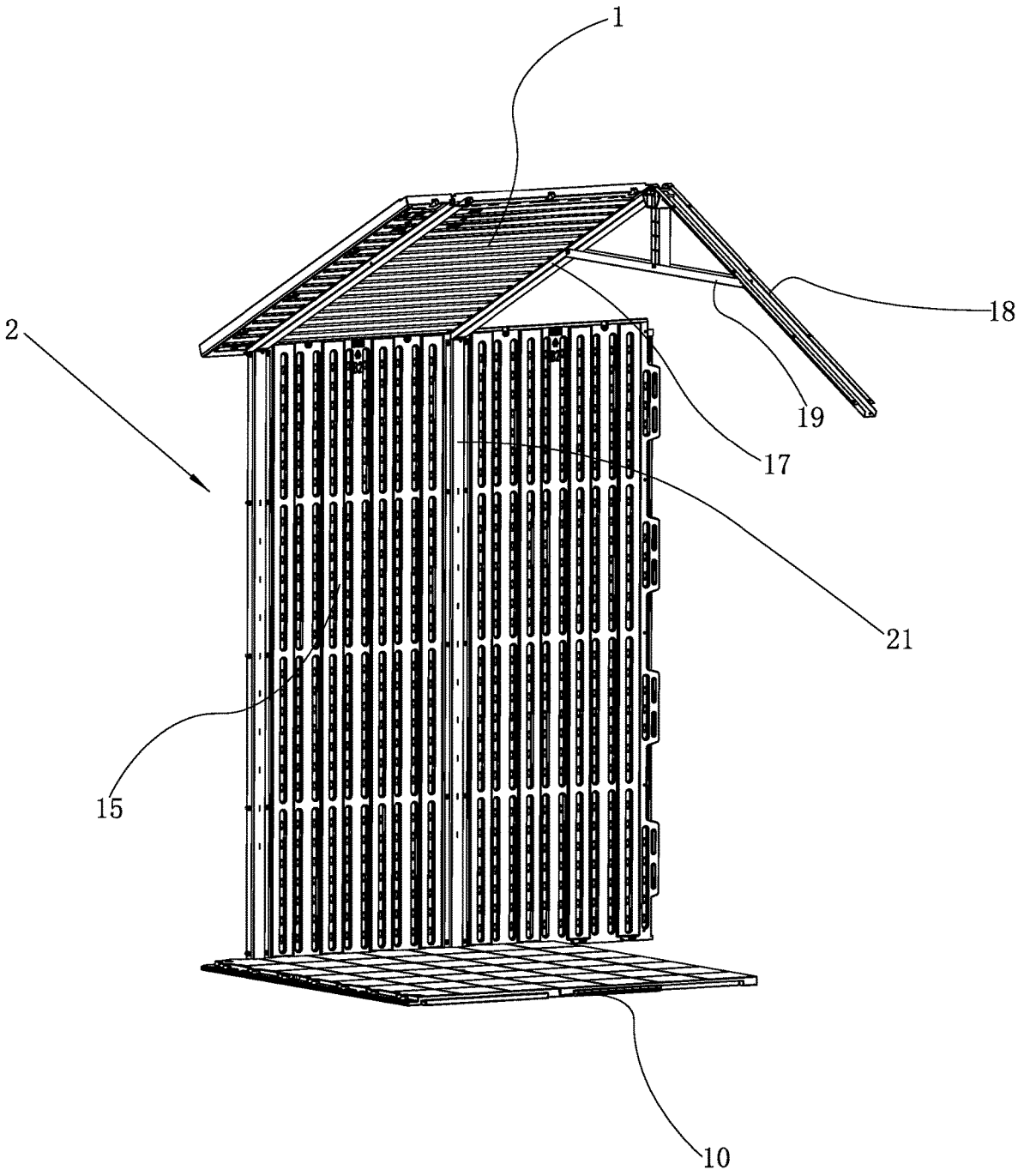
FIG. 2 is a second structural diagram of the shed according to the present disclosure.

1. top plate; 2. wallboard; 3. first contact surface; 4. second contact surface; 5. third contact surface; 6. first mounting surface; 7. second mounting surface; 8. third mounting surface; 9. fourth mounting surface; 10. floor; 11. first recess; 12. second recess; 13. working hole; 15. first support plate; 16. second support plate; 17. first support rod; 18. second support rod; 19. connecting rod; 20. mounting bracket; 21. connecting plate; 22. first protrusion; 23. first connecting groove; 24. first clamping connector; 25. positioning protrusion; 26. second positioning protrusion; 27. first positioning groove; 28. third recess; 29. first limit protrusion; 30. first working plate; 31. second working plate; 32. second clamping connector; 33. second connecting groove; 34. second protrusion; 35. hollow part; 36. protrusion; 37. step surface; 38. first limit groove; 39. second slope; 40. avoidance groove; 41. baffle; 42. first bottom plate; 43. first side plate; 44. first wing plate; 45. second bottom plate; 46. second side plate; 47. second wing plate; 48. first bottom wall; 49. first side wall; 50. second bottom wall; 51. second side wall; 52. recess structure; 53. protrusion portion; 54. first vertical plate; 55. second vertical plate; 56. third vertical plate; 57. second mounting portion; and 58. third mounting portion.

DETAILED DESCRIPTION OF THE EMBODIMENTS

In order for those skilled in the art to better understand the technical solution of the present disclosure, the present disclosure is described in detail clearly and completely below in combination with the drawings and embodiments. It should be understood that the specific embodiments described herein are merely intended to explain the present disclosure, rather than to limit the present disclosure.

It is understandable for those skilled in the art that in the description of the present disclosure, terms such as "longitudinal", "transverse" "upper", "lower", "front", "rear", "left", "right" "vertical", "horizontal", "top", "bottom", "inside", and "outside" indicate the orientation or position relationships based on the drawings. They are merely intended to facilitate and simplify the description of the present disclosure, rather than to indicate or imply that the mentioned system or components must have a specific orientation or must be constructed and operated in a specific orientation. Therefore, these terms should not be construed as a limitation to the present disclosure.

As shown in FIGS. 1, 2, 18, and 19, an embodiment of the present disclosure provides a shed, including top plates 1, a support frame, and multiple wallboards 2. The top plate 1 and the wallboards 2 are blow-molded, meaning that the wallboards 2 and the top plate 1 are hollow structures that are easy to transport, assemble, and disassemble. The wallboard 2 is provided with a first mounting portion. An end of the top plate 1 is provided with a first mounting groove. The first mounting portion is fit with the first mounting groove to connect the top plate 1 to the wallboard 2. In this way, the top plate 1 is clamped to the wallboard 2 through the first mounting groove, without the need for other components, making it convenient for assembly and disassembly. The top plates 1 include multiple first top plates 1 and multiple second top plates 1. The first top plates 1 are connected to the second top plates 1. The support frame includes first support rod 17. The first support rod 17 is provided at a junction between the first top plate 1 and the second top plate 1 to strengthen connection strength between each two adjacent top plates 1. Connecting plate 21 is provided at a junction between each two adjacent wallboards 2. The connecting plate 21 is made of a metal material. A first end of the connecting plate 21 is connected to a first end of the first support rod 17. On the one hand, the connecting plate 21 strengthens the connection strength between the two adjacent wallboards 2. On the other hand, the connecting plate 21 and the wallboard 2 play a supporting role, allowing the top plate 1 and the wallboard 2 of the shed to bear a significant load. A bottom of the wallboard 2 is connected to floor 10. The floor 10 is provided with first limit groove 38. A second end of the connecting plate 21 is provided in the first limit groove 38.

Specifically, as shown in FIGS. 3 to 8, the first mounting portion includes at least first mounting surface 6 and second mounting surface 7. The first mounting groove includes at least first contact surface 3 and second contact surface 4. After the top plate 1 is connected to the wallboard 2, the first contact surface 3 is at least partially adhered to the first mounting surface 6, and the second contact surface 4 is at least partially adhered to the second mounting surface 7. The first contact surface 3 is close to an edge of the top plate 1, and an area of contact between the first mounting surface 6 and the first contact surface 3 is greater than an area of contact between the second mounting surface 7 and the second contact surface 4. After the top plate 1 and the wallboard 2 are connected, an angle between the top plate 1 and the wallboard 2 is greater than 90°. In this way, the end of the top plate 1 with the first mounting groove is tilted downwards, making the connection between the top plate 1 and the wallboard 2 secure under the action of gravity.

In an embodiment of the present disclosure, the first mounting groove is an elongated groove, horizontally provided on an inner wall of the top plate 1. The first contact surface 3 and the second contact surface 4 are provided on an inner wall of the first mounting groove. The first contact surface 3 and the second contact surface 4 form two side walls of the first mounting groove, respectively. A width of the first contact surface 3 is greater than a width of the second contact surface 4. The first mounting portion is provided at an upper end of the wallboard 2 and horizontally provided along the upper end of the wallboard 2. A width of the first mounting surface 6 is greater than a width of the second mounting surface 7, such that the side of the wallboard 2 with the first mounting surface 6 is deeply clamped into the first mounting groove. The width of the first mounting surface 6 is greater than the width of the second mounting surface 7, and the width of the first contact surface 3 is greater than the width of the second contact surface 4. In this way, after the top plate 1 and the wallboard 2 are connected, the first mounting surface 6 and the first contact surface 3 have a large stress area. The top plate 1 can resist large external forces and is not easily collapsed, and the first mounting portion and the first mounting groove are firmly fit.

Furthermore, the first mounting portion includes third mounting surface 8. The third mounting surface 8 is provided between the first mounting surface 6 and the second mounting surface 7. The first mounting groove further includes third contact surface 5. The third contact surface 5 is provided between the first contact surface 3 and the second contact surface 4. After the top plate 1 and the wallboard 2 are connected, the third contact surface 5 is at least partially adhered to the third mounting surface 8. After the top plate 1 and the wallboard 2 are connected, a junction between the first mounting surface 6 and the third mounting surface 8 is adhered to a junction between the first contact surface 3 and the third contact surface 5. Preferably, an angle between the first contact surface 3 and the third contact surface 5 is greater than 90° but less than 180°, and an angle between the second contact surface 4 and the third contact surface 5 is less than or equal to 90°. In this way, under the action of gravity, the end of the top plate 1 with the first mounting groove has a downward trend, making the mounting of the top plate 1 and the wallboard 2 tight and secure.

Figure 3:
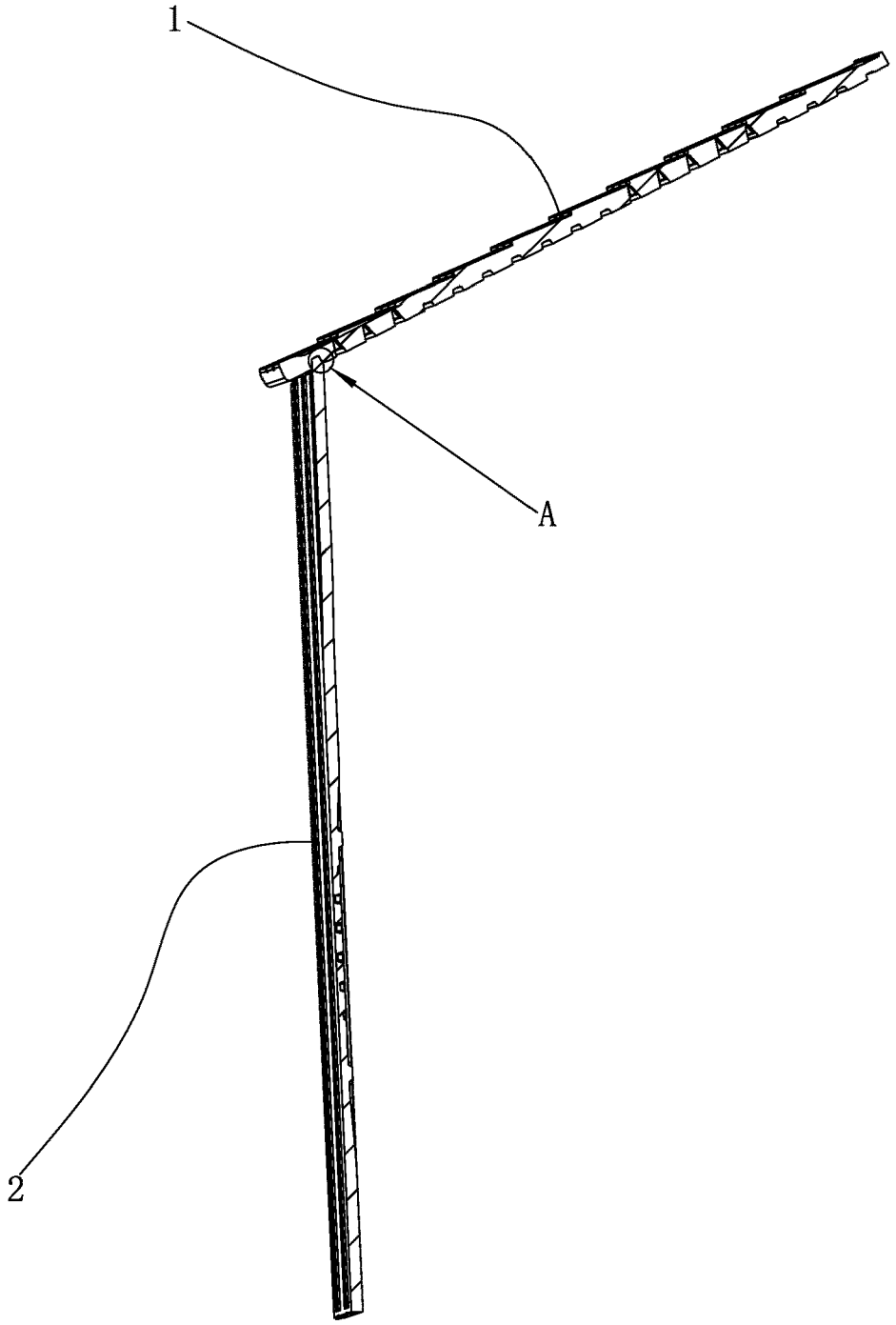
FIG. 3 is a sectional view of a wallboard and a top plate that are connected according to the present disclosure.
Figure 4:
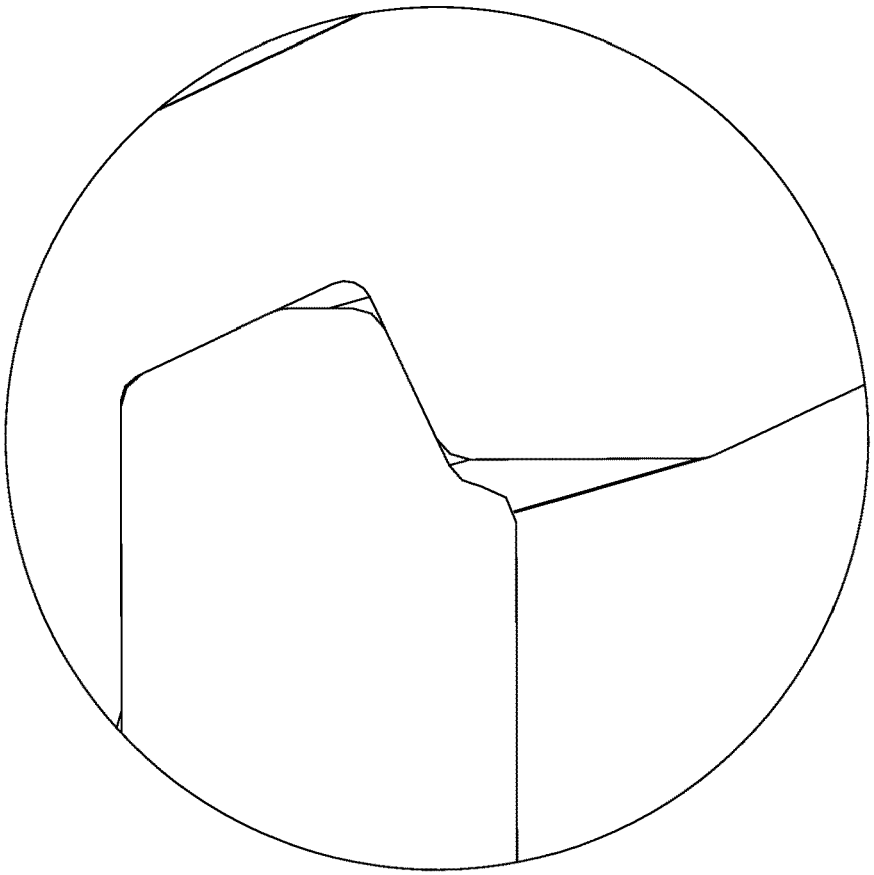
FIG. 4 is an enlarged view of A shown in FIG. 3.
Figure 5:
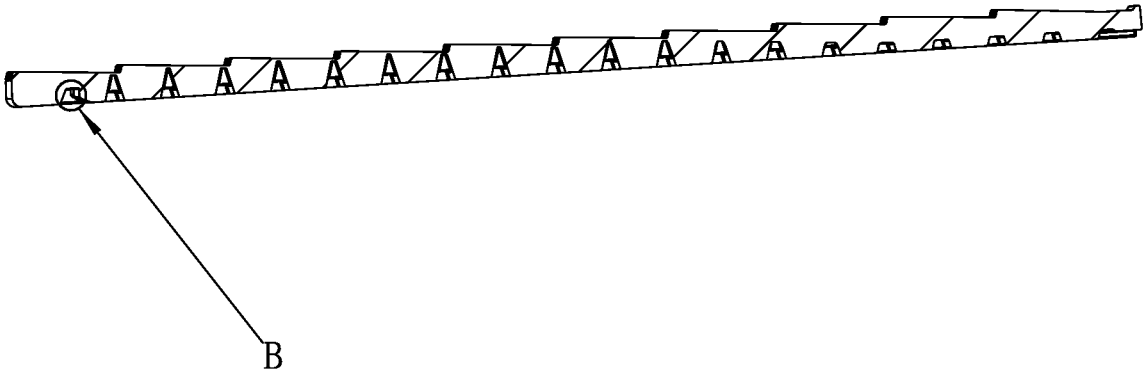
FIG. 5 is a first structural diagram of a top plate according to the present disclosure.
Figure 6:
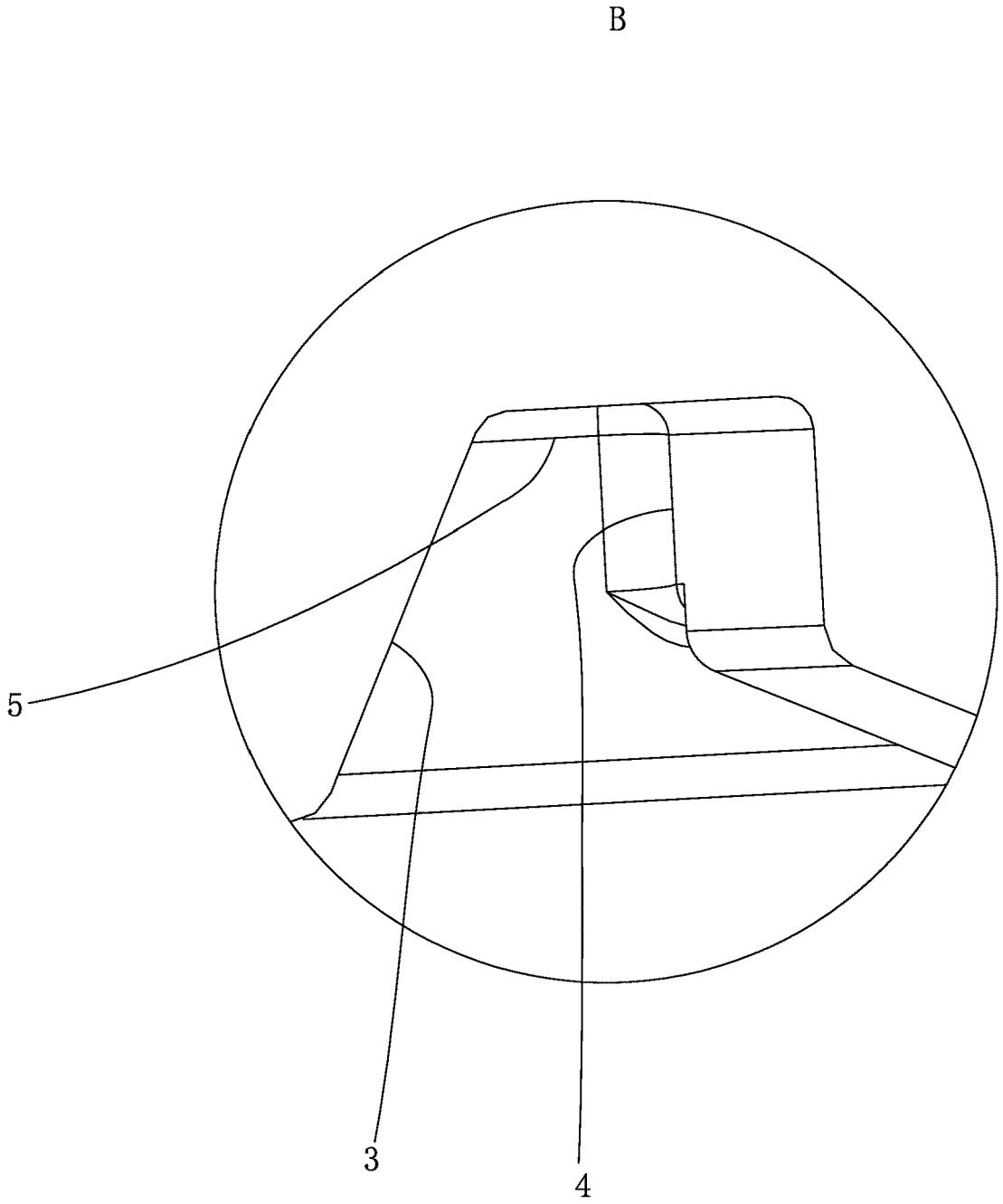
FIG. 6 is an enlarged view of B shown in FIG. 5.
Figure 7:
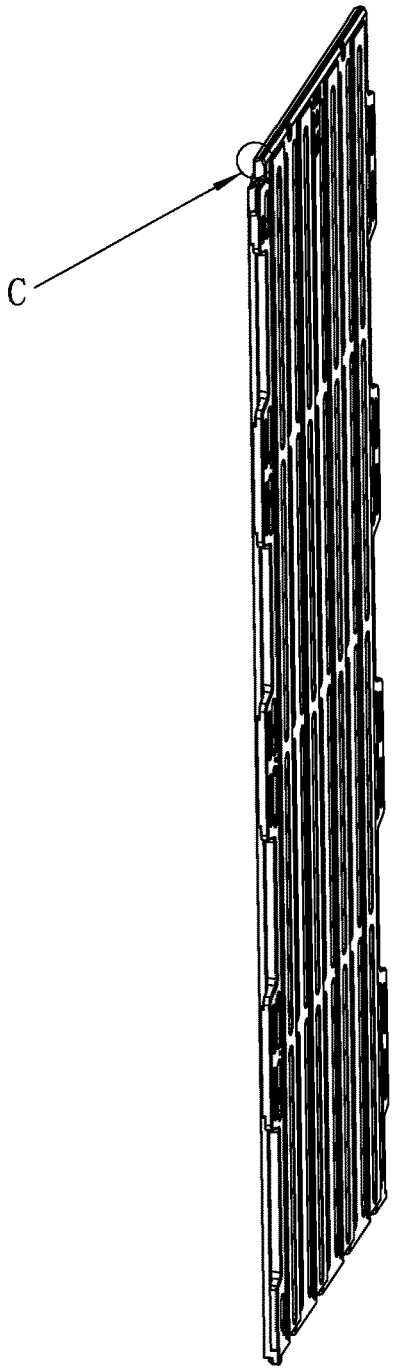
FIG. 7 is a first structural diagram of a first support plate according to the present disclosure.
Figure 8:
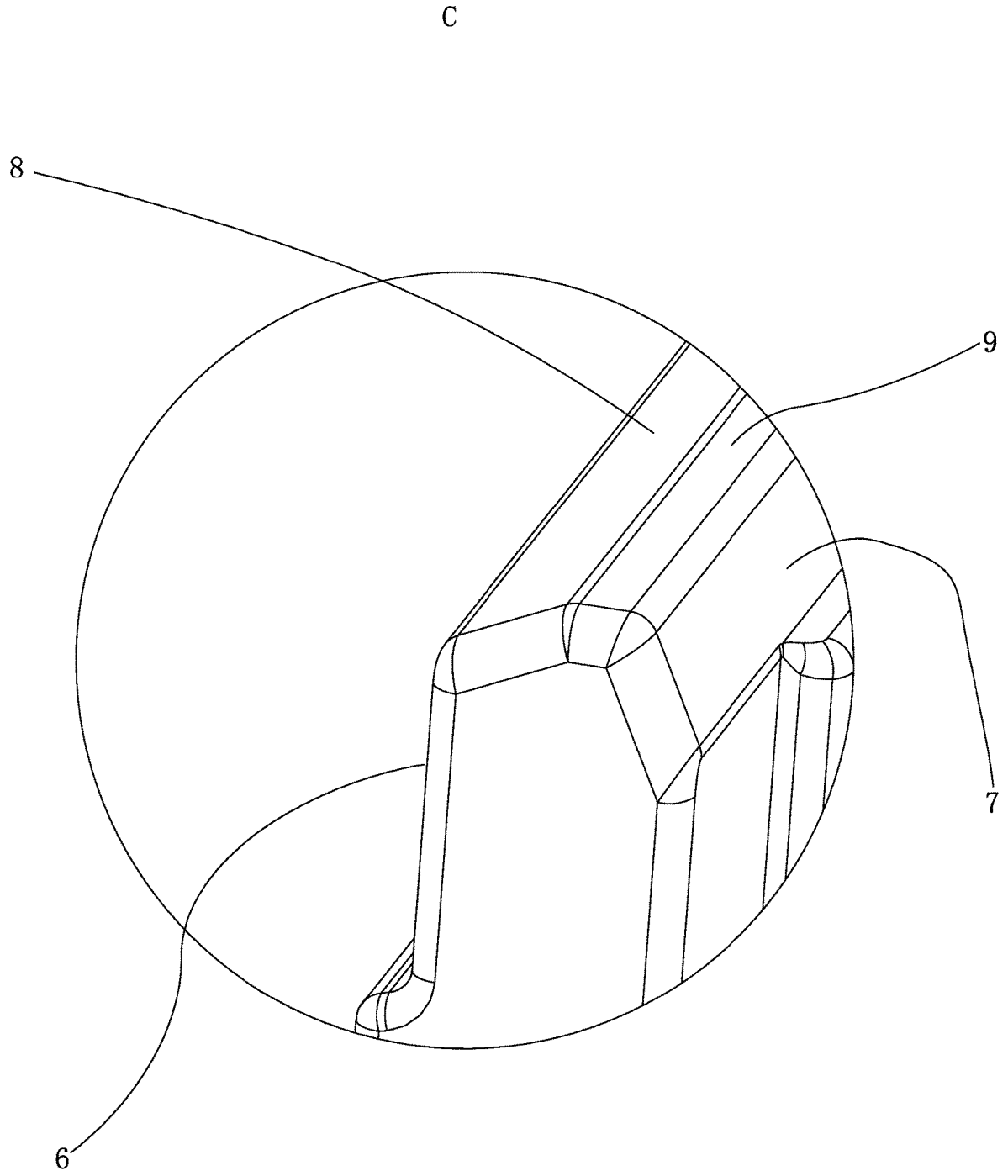
FIG. 8 is an enlarged view of C shown in FIG. 7.

Furthermore, as shown in FIGS. 3 and 4, the first mounting portion includes fourth mounting surface 9. The fourth mounting surface 9 is provided between the second mounting surface 7 and the third mounting surface 8. A width of the third contact surface 5 is greater than a width of the third mounting surface 8. After the top plate 1 and the wallboard 2 are connected, the fourth mounting surface 9 is located below a junction between the second contact surface 4 and the third contact surface 5. There is a gap between the fourth mounting surface 9 and the junction to protect the mounting portion and the junction from being stuck. If the junction is stuck, it will become a main point of force, causing significant wear. Therefore, the gap avoids wear and ensures a secure junction between the first mounting groove and the first mounting portion.

As shown in FIGS. 9 to 10, 12, and 13, in order to further strengthen the connection strength between the wallboard 2 and the top plate 1, working hole 13 is provided at an upper side of the wallboard 2. One end of a bolt passes through the working hole 13 and is connected to the top plate 1. Specifically, an inner side of the wallboard 2 is provided with first recess 11. The first recess 11 is provided at the upper side of the wallboard 2 and extends to the second mounting surface 7. The working hole 13 is located in the first recess 11. An outer side of the wallboard 2 is provided with second recess 12. The second recess 12 is provided at the upper side of the wallboard 2. The second recess 12 corresponds to the first recess 11 in terms of position. The working hole 13 is located in the second recess 12. Due to the first recess 11 and the second recess 12, the plate at the position of the working hole 13 is relatively thin, making it easy for the bolt to pass through the wallboard 2 to connect the top plate 1.

As shown in FIGS. 26 to 30, in an embodiment of the present disclosure, the support frame further includes second support rod 18. A second end of the first support rod 17 is connected to a first end of the second support rod 18. After the first support rod 17 and the second support rod 18 are connected, an angle between the first support rod and the second support rod is greater than 90° but less than 180°. The support frame further includes connecting rod 19. One end of the connecting rod 19 is connected to the first support rod 17, and the other end of the connecting rod 19 is connected to the second support rod 18. It should be noted that the structures of the first support rod 17 and the second support rod 18 are basically the same. A second end of the second support rod 18 is connected to another connecting plate 21, and the first support rod 17 and the second support rod 18 each are roughly in an inverted U-shaped structure. The first support rod 17, the second support rod 18, and the connecting rod 19 are connected to form a triangle. The triangle is stable, making the structure of the support frame stable.

Figure 9:
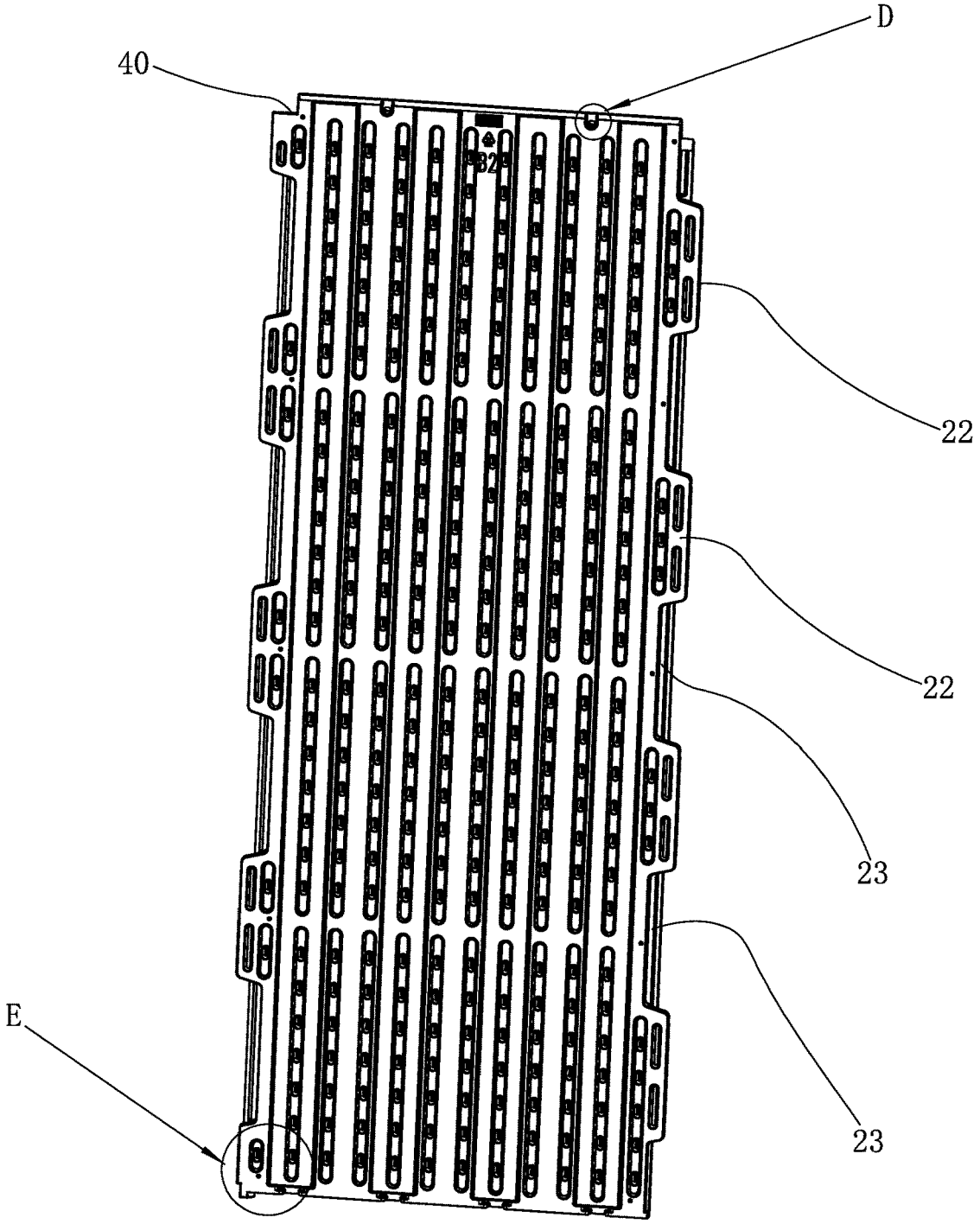
FIG. 9 is a second structural diagram of the first support plate according to the present disclosure.
Figure 10:
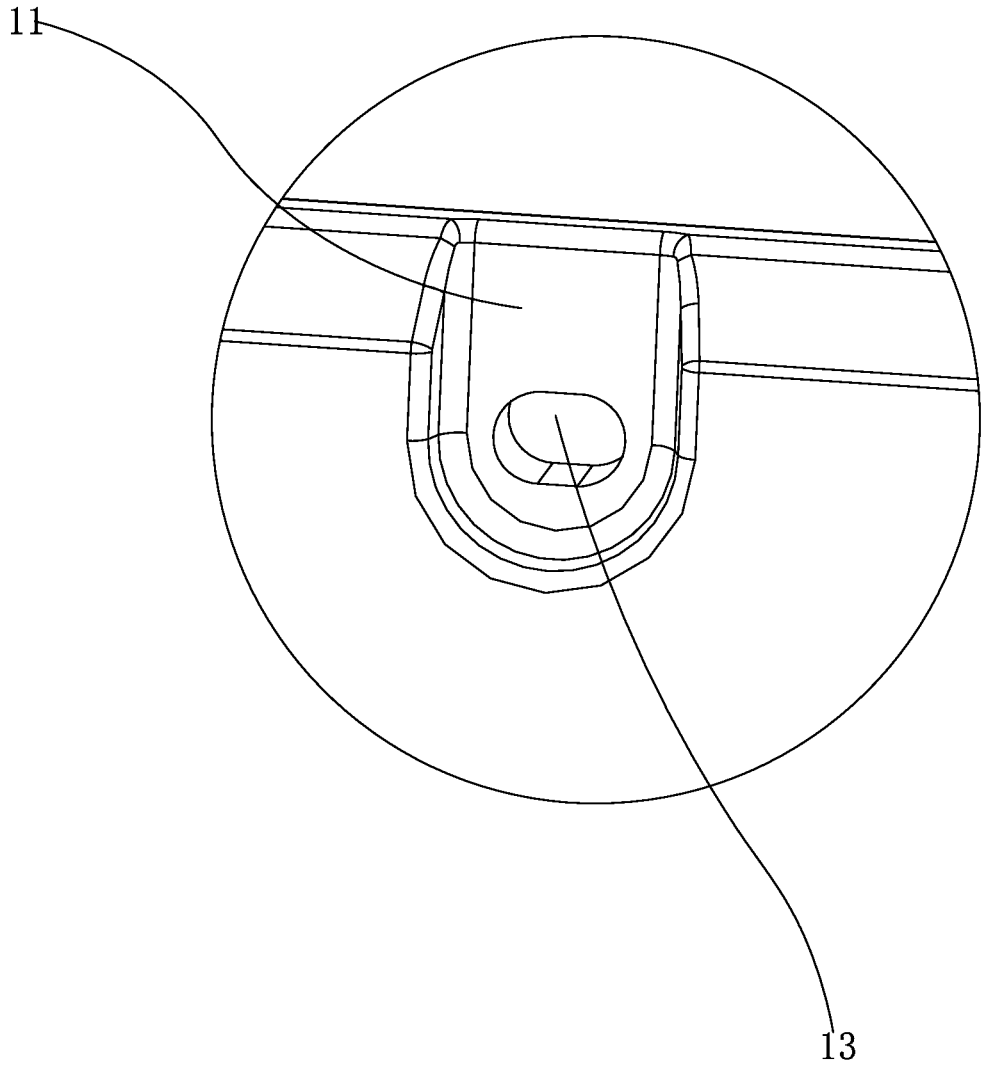
FIG. 10 is an enlarged view of D shown in FIG. 9.
Figure 11:
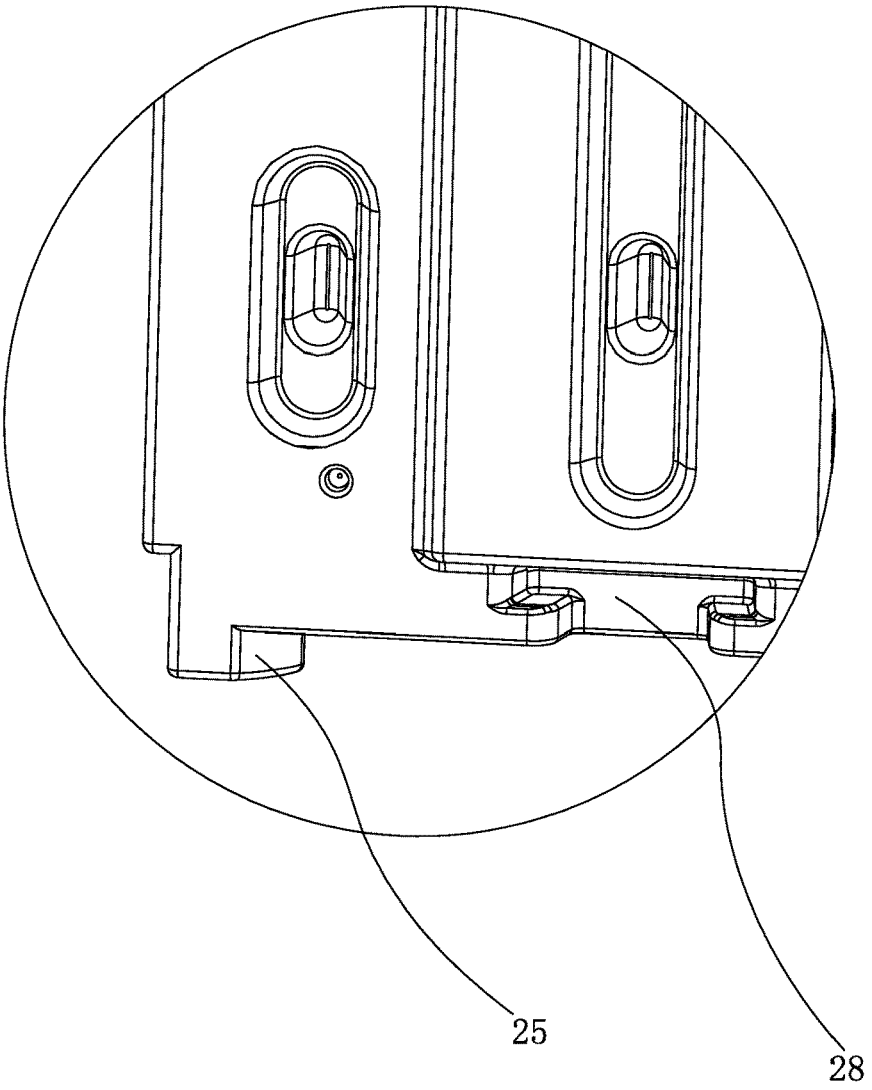
FIG. 11 is an enlarged view of E shown in FIG. 9.
Figure 12:
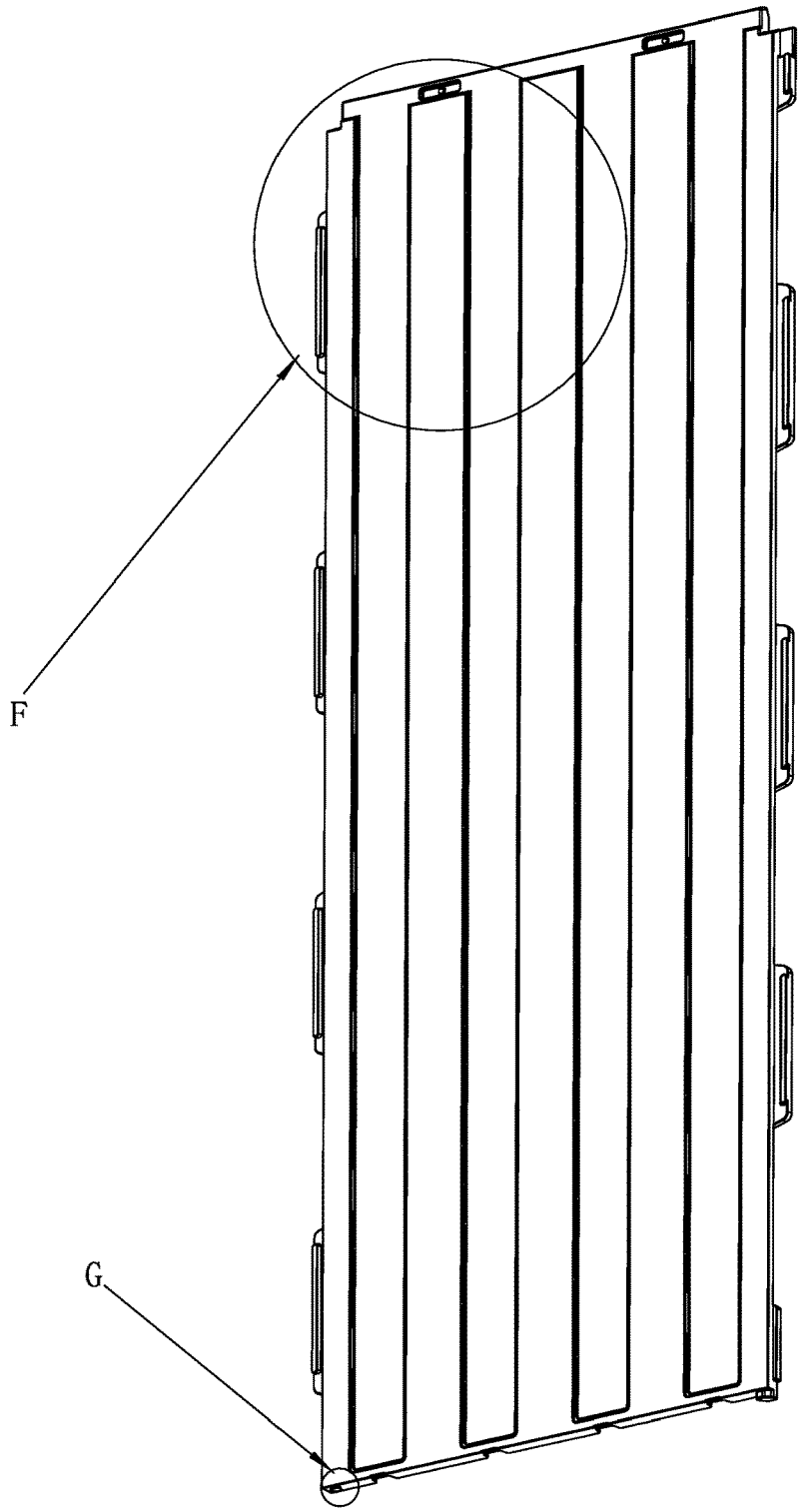
FIG. 12 is a third structural diagram of the first support plate according to the present disclosure.
Figure 13:
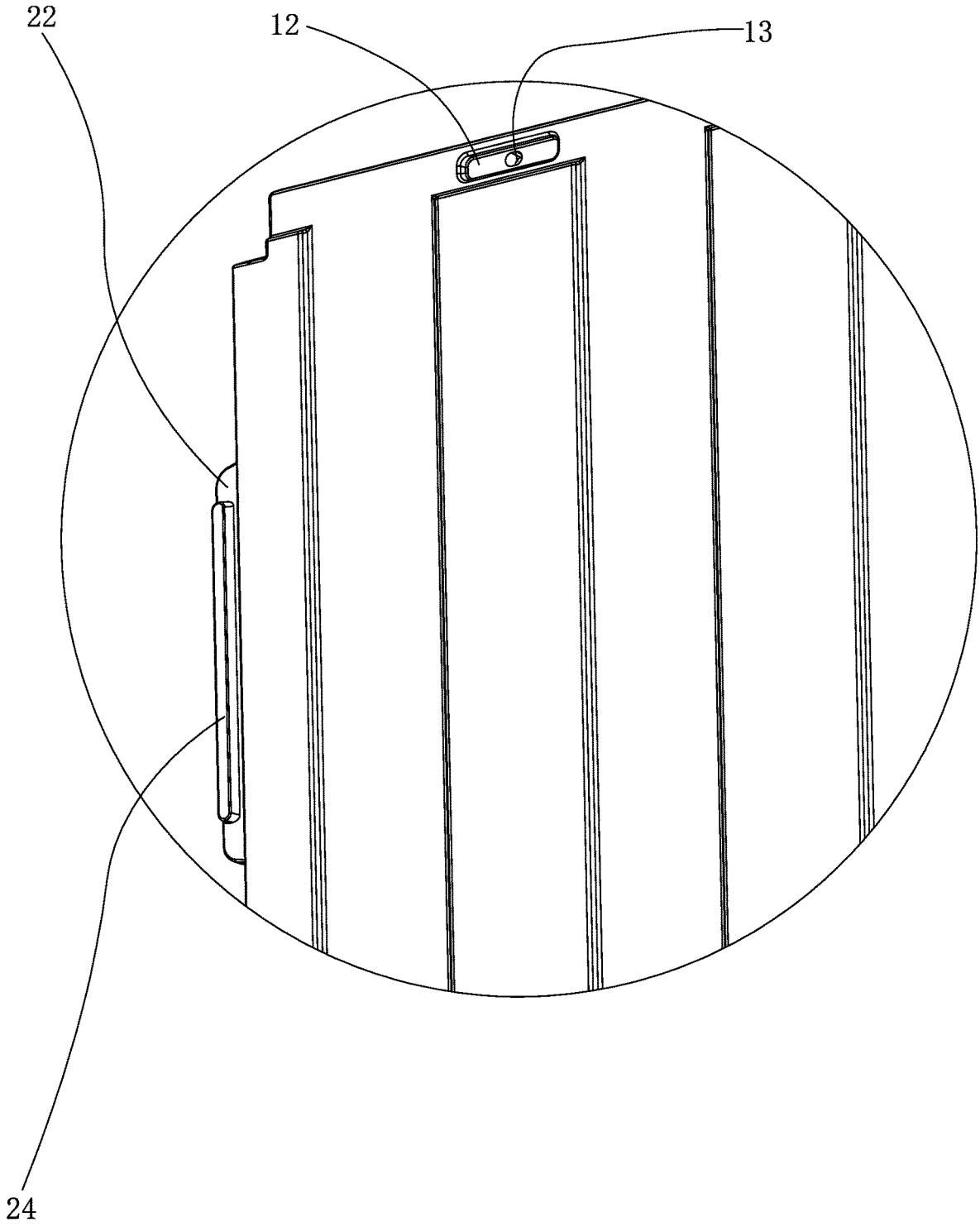
FIG. 13 is an enlarged view of F shown in FIG. 12.
Figure 14:
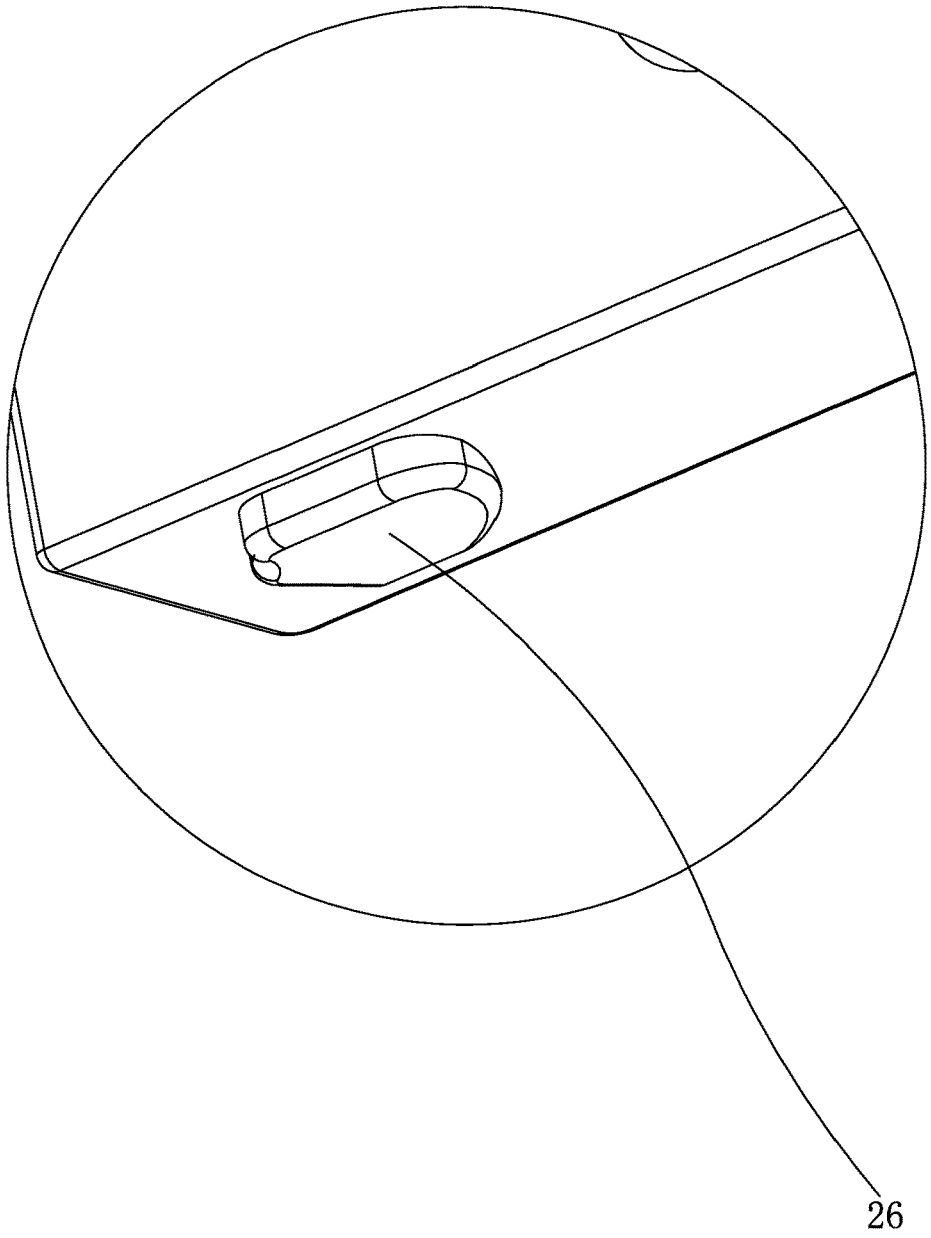
FIG. 14 is an enlarged view of G shown in FIG. 12.
Figure 15:
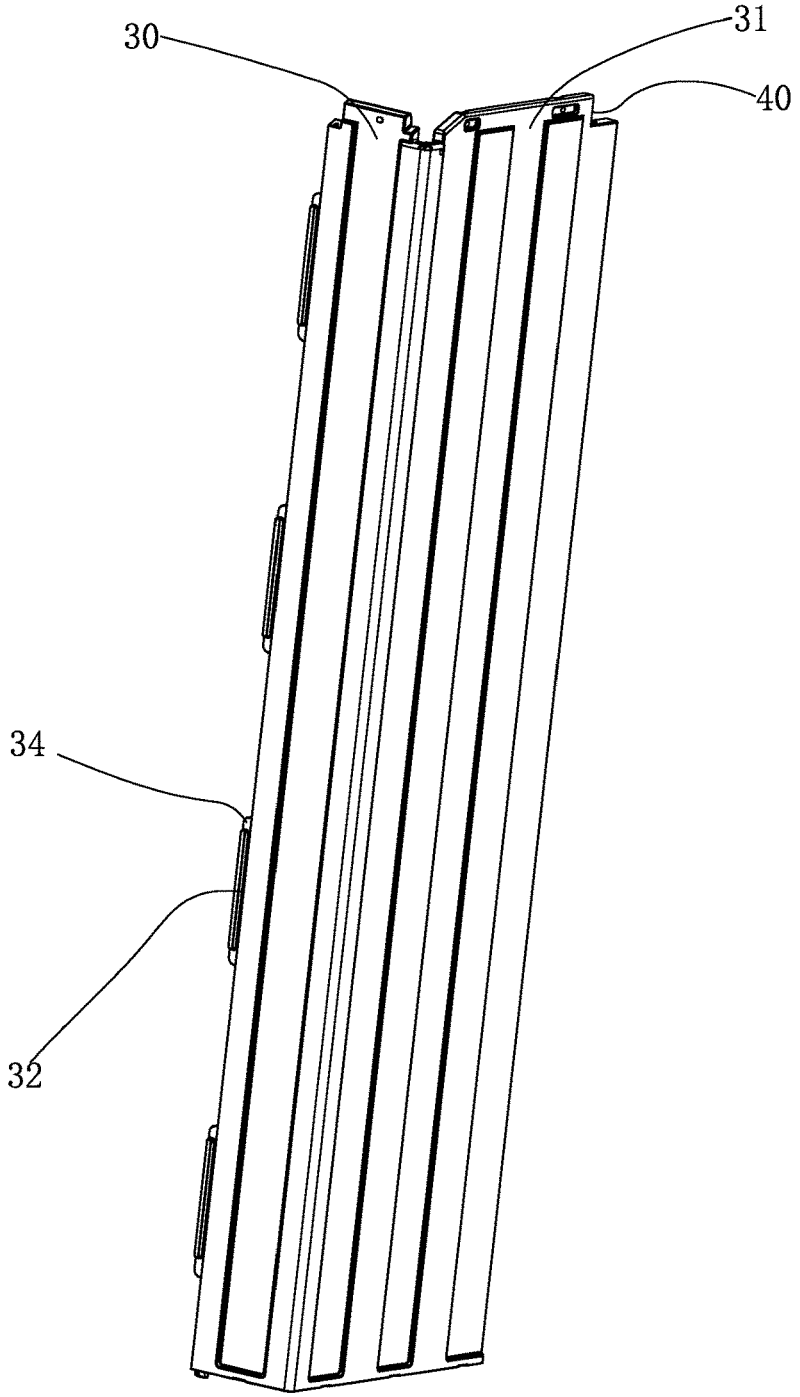
FIG. 15 is a first structural diagram of a second support plate according to the present disclosure.
Figure 16:
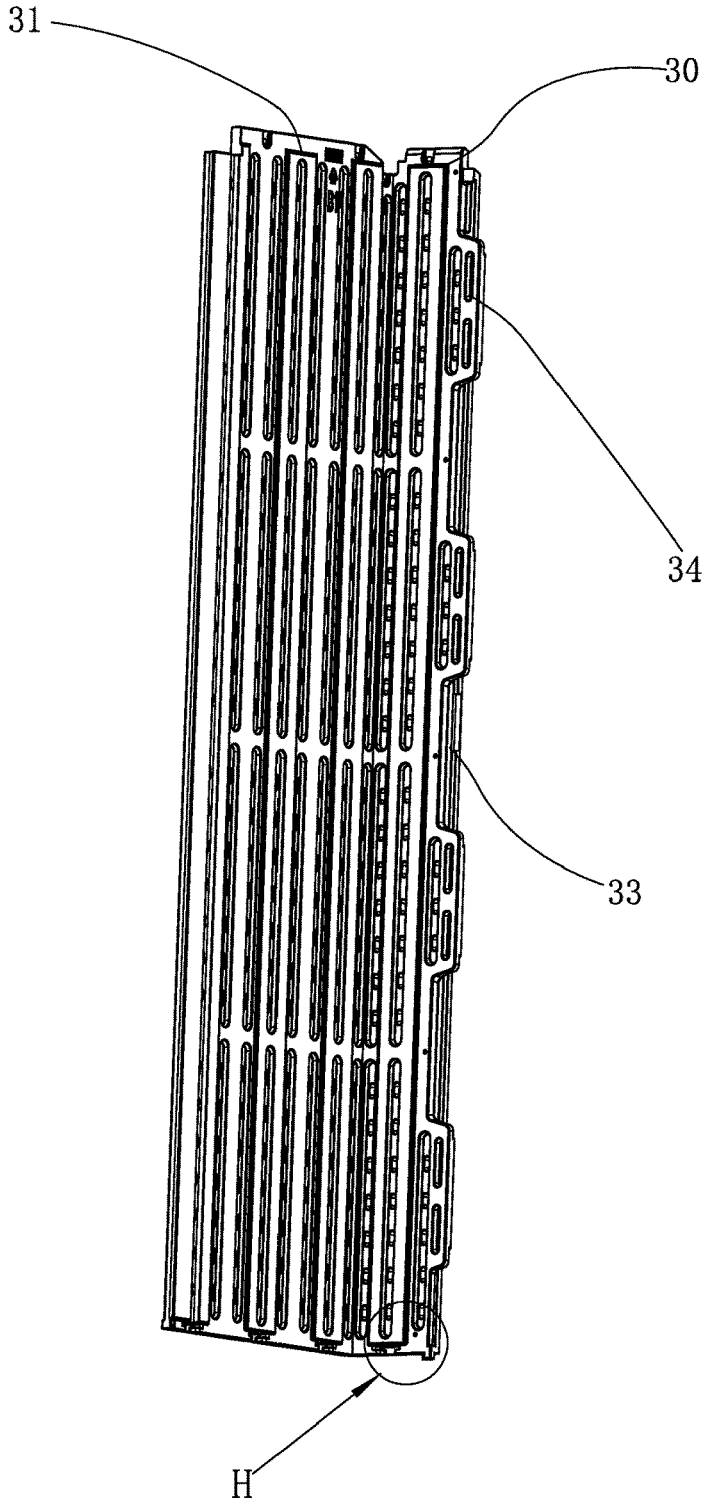
FIG. 16 is a second structural diagram of the second support plate according to the present disclosure.
Figure 17:
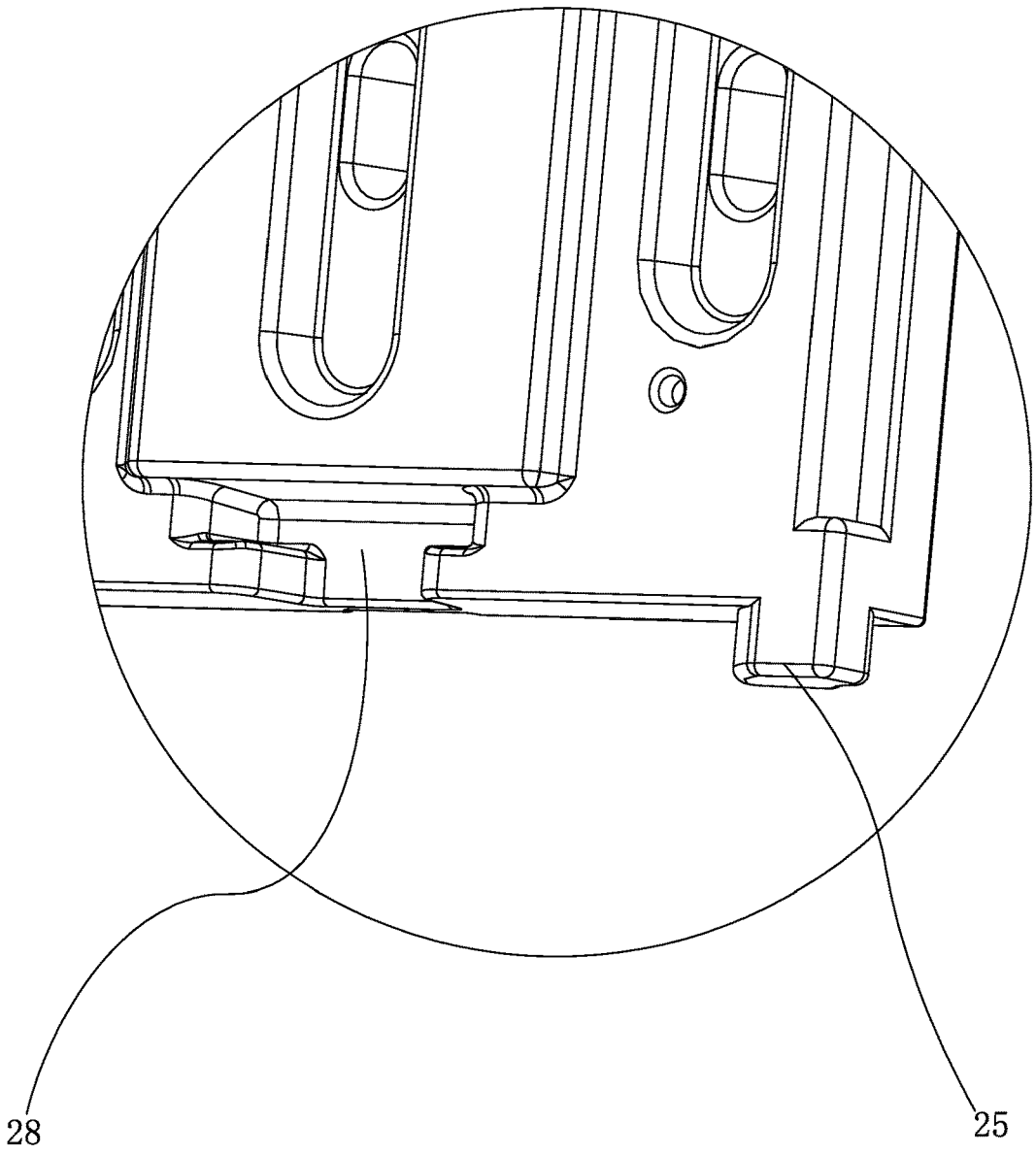
FIG. 17 is an enlarged view of H shown in FIG. 16.

Furthermore, as shown in FIGS. 9 and 15, the first support rod 17 and the second support rod 18 each are provided with a first flow channel. The first flow channel is located directly below a junction between two adjacent top plates 1. If rainwater seeps into the junction between the first top plate 1 and the second top plate 1, it falls into the first flow channel and is discharged by the first flow channel, effectively avoiding water seepage or leakage into a roof of the shed. Particularly, avoidance grooves 40 are provided at two sides of the wallboard 2. The avoidance grooves 40 are located at the sides of the first mounting portion. The first support rod 17 or the second support rod 18 at least partially passes through the avoidance groove 40, such that the first support rod 17 or the second support rod 18 extends out of an outer side of the wallboard 2. In this way, rainwater is discharged along the first flow channel 14 to the outside of the shed.

As shown in FIGS. 26 to 33, in an embodiment of the present disclosure, the connecting rod 19 is provided with mounting bracket 20. The first support rod 17 is connected to the second support rod 18 through the mounting bracket 20. Specifically, the mounting bracket 20 is made of a plastic material to reduce the weight of the entire shed. A bottom of the mounting bracket 20 is provided in a middle of the connecting rod 19 to achieve force balance, thereby achieving a firm structure of the support frame. The mounting bracket 20 is connected to the connecting rod 19 by a bolt. An upper part of the mounting bracket 20 is provided with a first working groove and a second working groove. The second end of the first support rod 17 is provided in the first working groove, and the first end of the second support rod 18 is provided in the second working groove. The mounting bracket 20 includes two parts, namely the upper part and a lower part. The lower part is a rod-shaped structure. A bottom of the rod-shaped structure is connected to the connecting rod 19 by a bolt. The upper part is a block-like structure. The first working groove and the second working groove are provided on the block-like structure.

The first support rod 17 includes first bottom plate 42. Two sides of the first bottom plate 42 are respectively provided with first side plates 43. The first side plates 43 are connected to first wing plates 44 to approximate the first support rod 17 in an inverted U-shaped structure. The first flow channel on the first support rod 17 is formed by the first bottom plate 42 and the first side plates 43 at two sides. The first working groove is a U-shaped groove. A length of the first working groove is much smaller than a length of the first support rod 17. The first working groove includes first bottom wall 48 and first side walls 49 provided at two sides of the first bottom wall 48. After the first support rod 17 is connected to the first working groove, the first bottom plate 42 is at least partially in contact with the first bottom wall 48, and the first side plate 43 is at least partially in contact with the first side wall 49. The two first side walls 49 are provided with at least one set of first mounting holes, and the two first side plates 43 are provided with at least one set of second mounting holes. The first mounting hole corresponds to the second mounting hole in terms of position. A bolt passes through the first mounting hole and the second mounting hole to connect the first support rod 17 to the first working groove. The second support rod 18 includes second bottom plate 45. Two sides of the second bottom plate 45 are respectively provided with second side plates 46. The second side plates 46 are connected to second wing plates 47 to approximate the second support rod 18 in an inverted U-shaped structure. The first flow channel on the second support rod 18 is formed by the second bottom plate 45 and the second side plates 46 at two sides. The second working groove is a U-shaped groove. A length of the second working groove is much smaller than a length of the second support rod 18. The second working groove includes second bottom wall 50 and second side walls 51 provided at two sides of the second bottom wall 50. After the second support rod 18 is connected to the second working groove, the second bottom plate 45 is at least partially in contact with the second bottom wall 50, and the second side plate 46 is at least partially in contact with the second side wall 51. Preferably, the two second side walls 51 are provided with at least one set of third mounting holes, and the two second side plates 46 are provided with at least one set of fourth mounting holes. The third mounting hole corresponds to the fourth mounting hole in terms of position. A bolt passes through the third mounting hole and the fourth mounting hole to connect the second support rod 18 to the second working groove.

It should be noted that the mounting bracket 20 is provided with baffles 41. A first clamping groove is formed between the baffle 41 and the first working groove. The first clamping groove is a gap between the baffle 41 and the first bottom wall 48, and between the baffle 41 and the first side wall 49. An end portion of an end of the first support rod 17 connected to the mounting bracket 20 is located in the first clamping groove. A second clamping groove is formed between the baffle 41 and the second working groove. The second clamping groove is a gap between the baffle 41 and the second bottom walls 50, and between the baffle 41 the second side wall 51. An end portion of an end of the second support rod 18 connected to the mounting bracket 20 is located in the second clamping groove. In this way, the end portion of the end of the first support rod 17 connected to the mounting bracket 20 and the end portion of the end of the second support rod 18 connected to the mounting bracket 20 are covered by the baffles 41 to prevent rainwater from entering the shed through the first support rod 17 or the second support rod 18. Since the end portion of the end of the first support rod 17 connected to the mounting bracket 20 and the end portion of the end of the second support rod 18 connected to the mounting bracket 20 are covered by the baffles 41, rainwater is discharged along the first flow channel.

Figure 34:
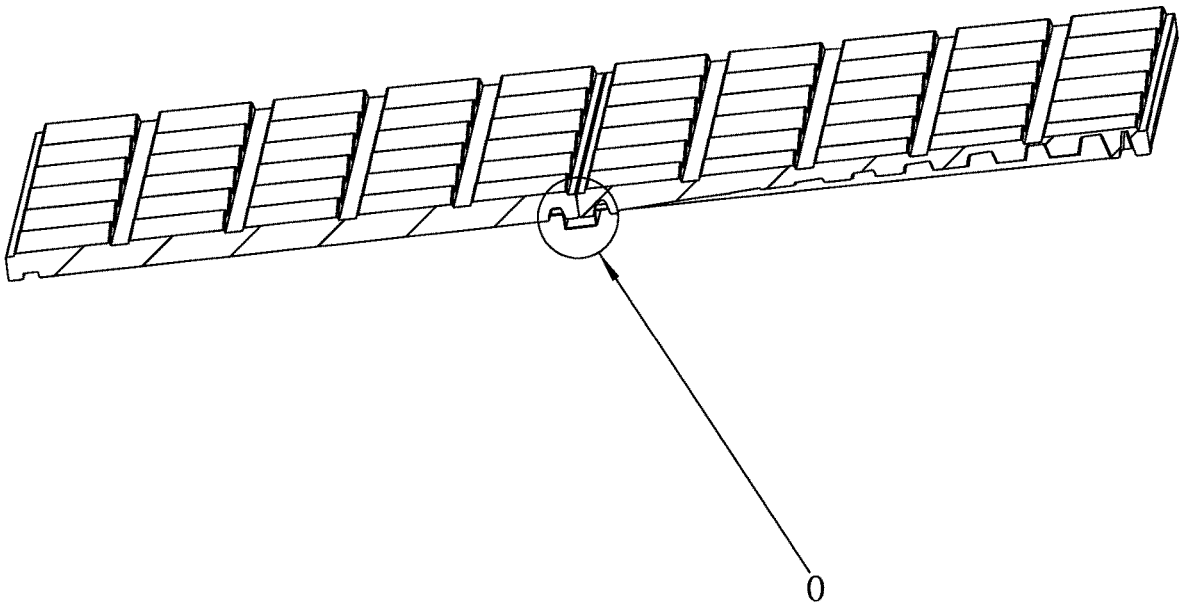
FIG. 34 is a structural diagram of the top plate and the support frame that are connected according to the present disclosure.
Figure 35:
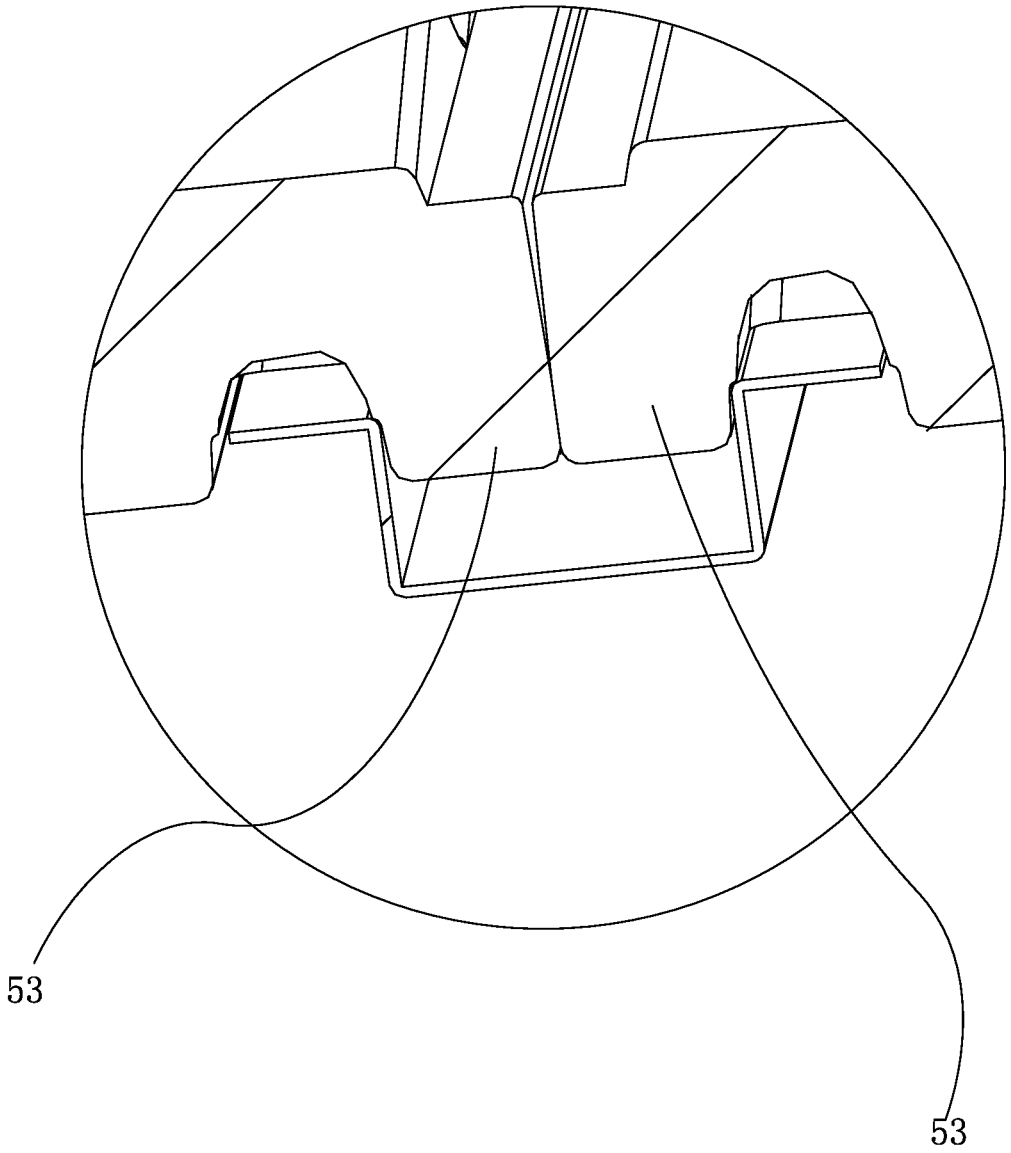
FIG. 35 is an enlarged view of O shown in FIG. 34.
Figure 36:
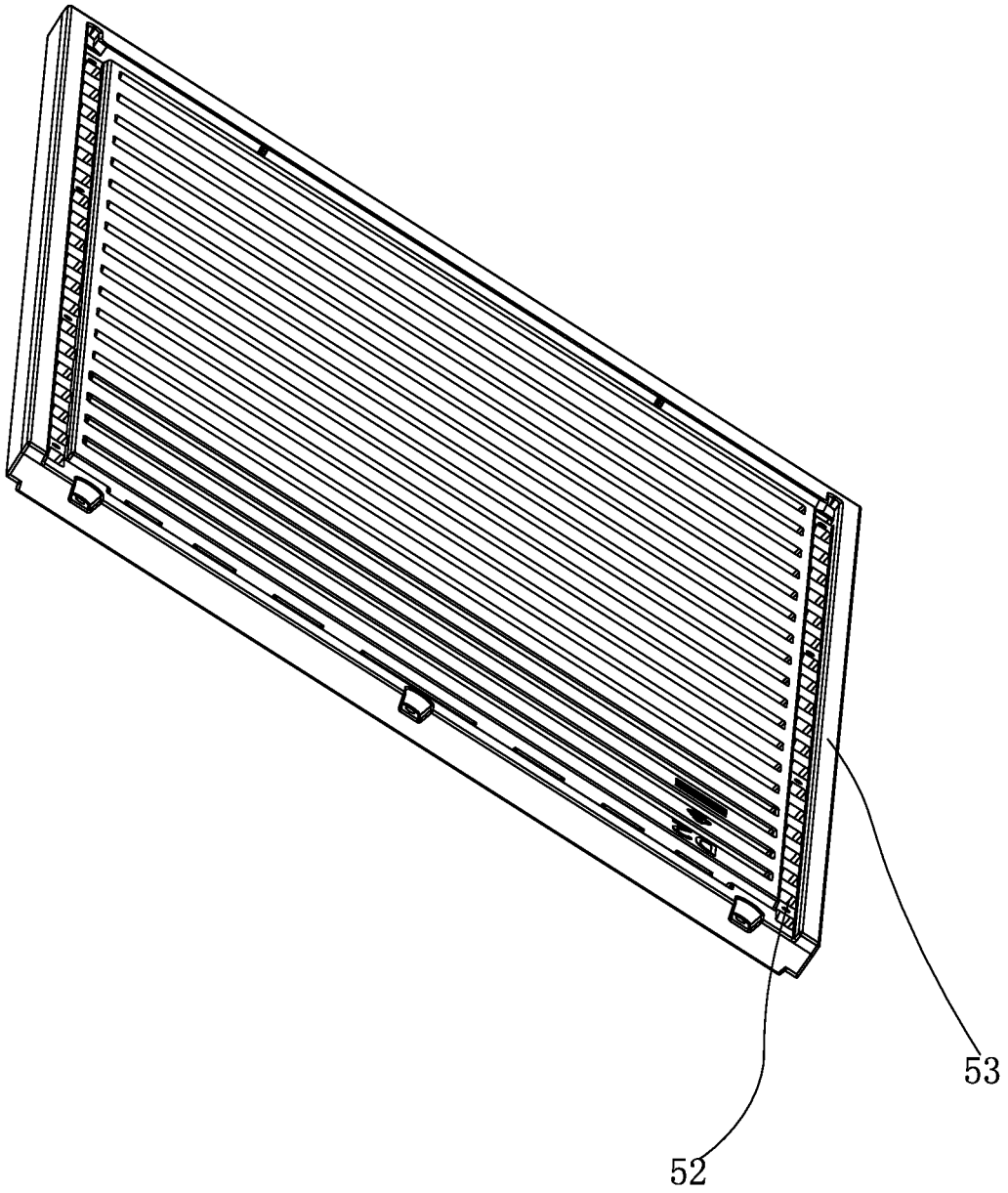
FIG. 36 is a second structural diagram of the top plate according to the present disclosure.
Figure 37:
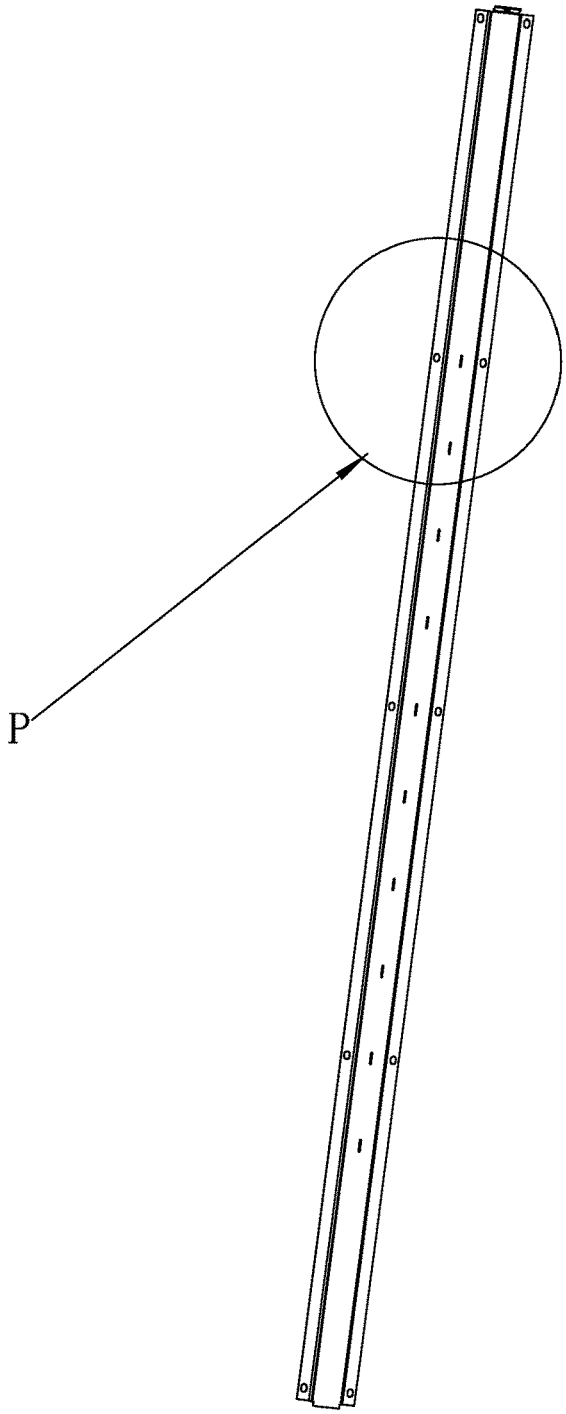
FIG. 37 is a first structural diagram of a connecting plate according to the present disclosure.
Figure 38:
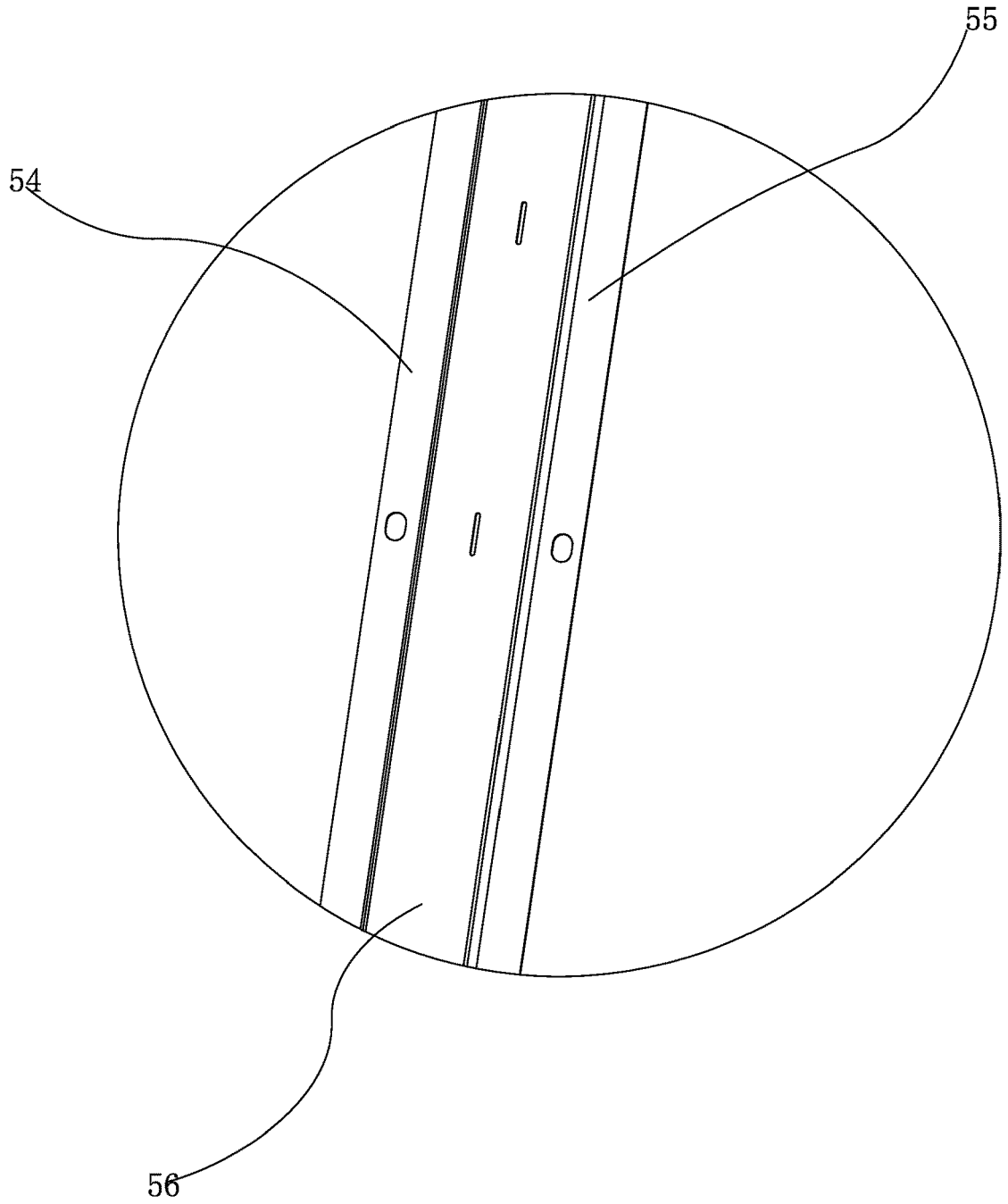
FIG. 38 is an enlarged view of P shown in FIG. 37.
Figure 39:
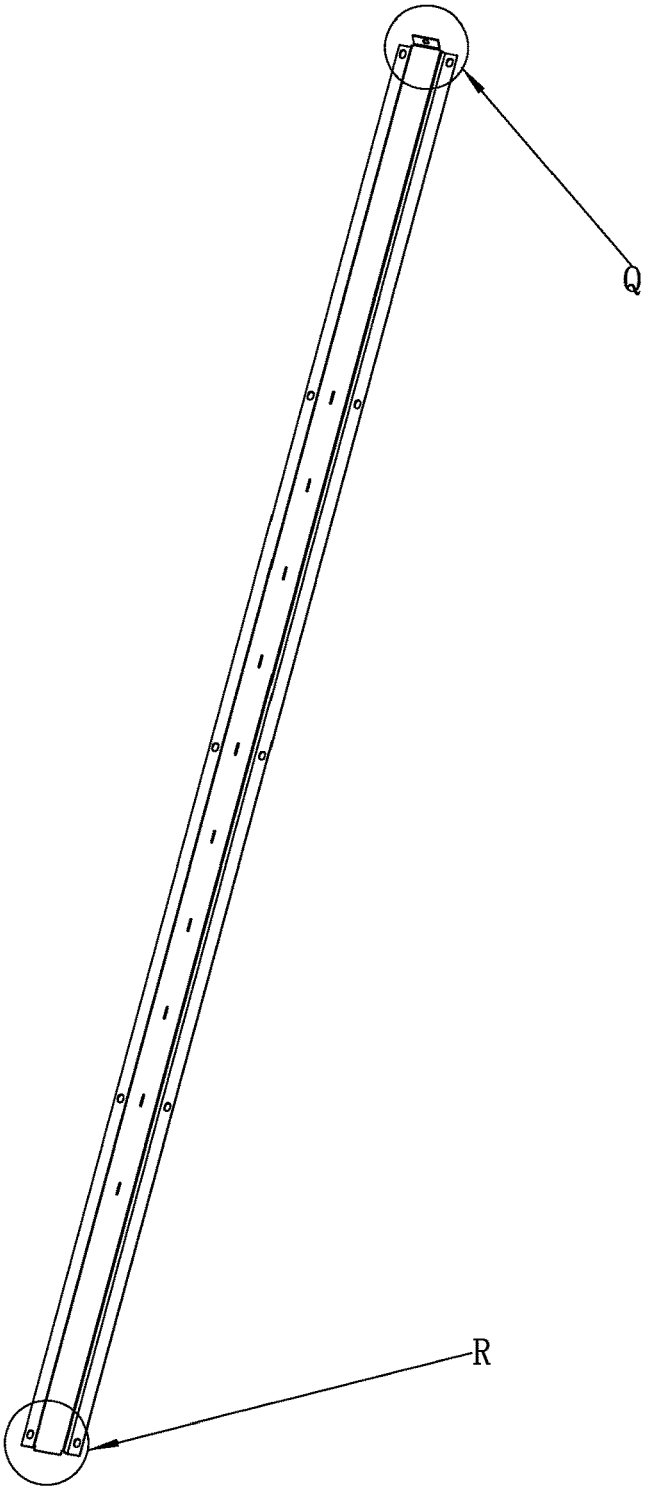
FIG. 39 is a second structural diagram of the connecting plate according to the present disclosure.
Figure 40:
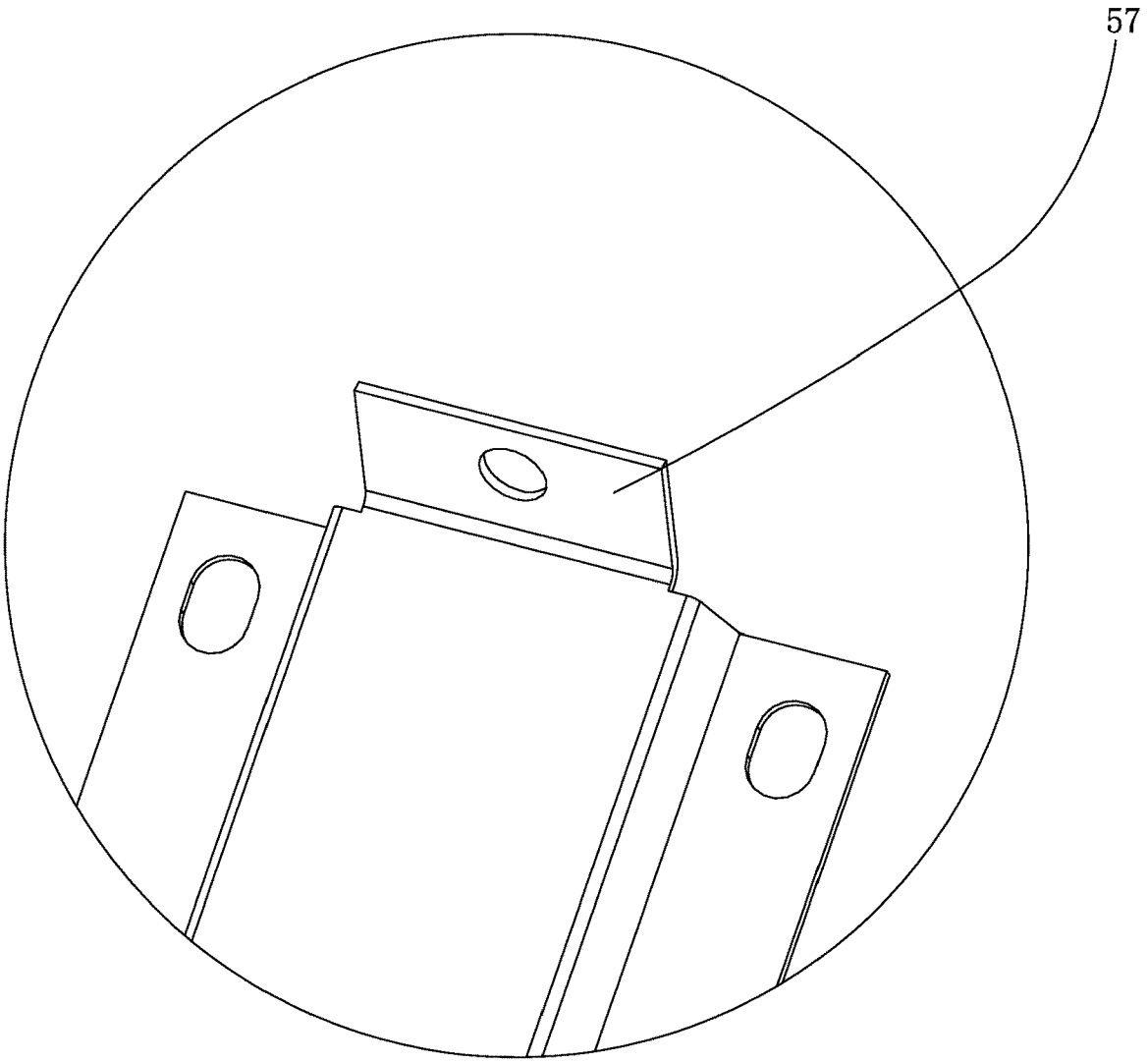
FIG. 40 is an enlarged view of Q shown in FIG. 39.
Figure 41:
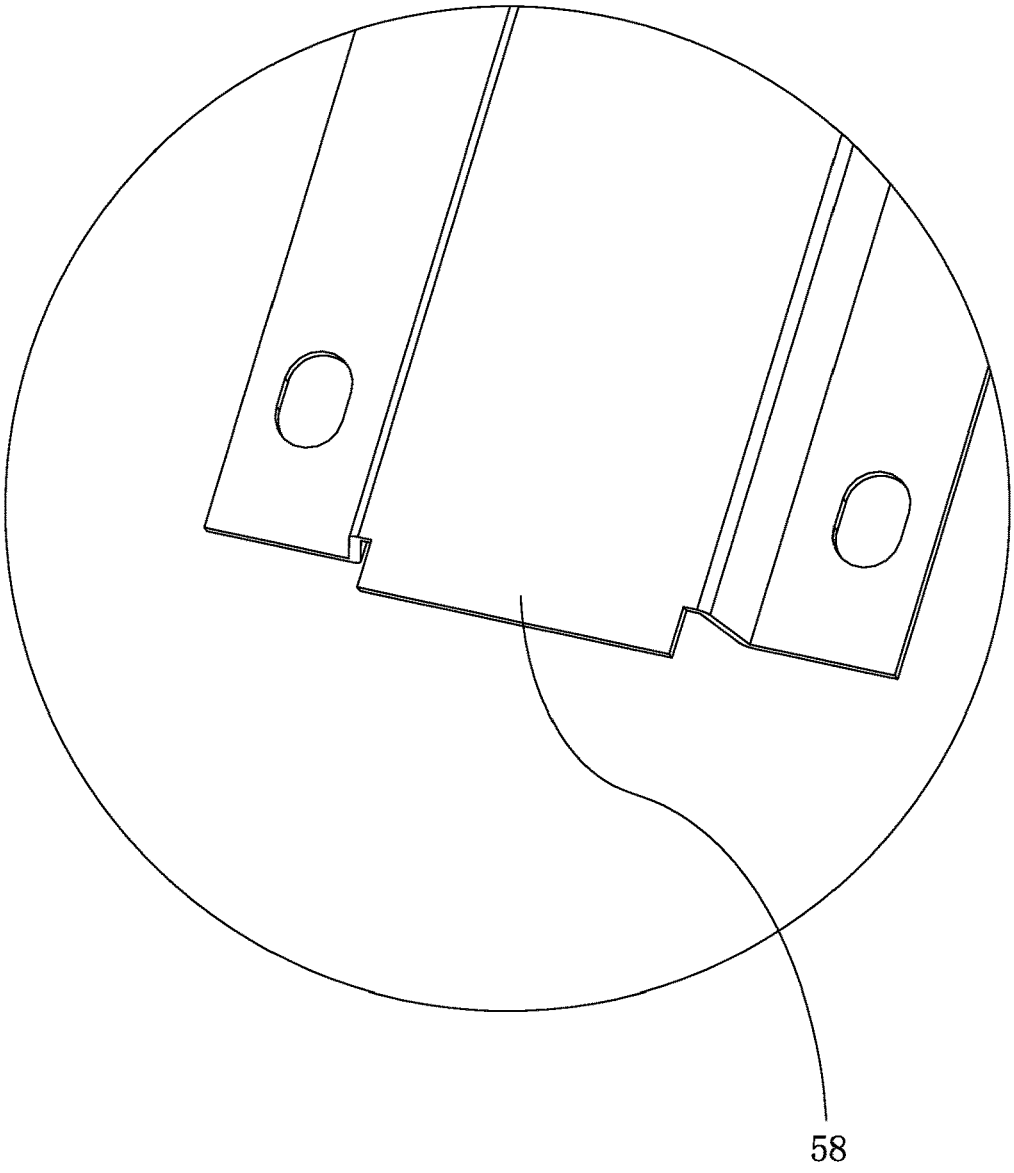
FIG. 41 is an enlarged view of R shown in FIG. 39.

As shown in FIGS. 34 to 36, particularly, recess structures 52 are respectively provided at two sides of the top plate 1. An outer side of the recess structure 52 is provided with protrusion portion 53. The protrusion portion 53 is a raised strip-like structure. After the top plate 1 is connected to the first support rod 17, the protrusion portion 53 is located at an inner side of the first side plate 43. The first wing plate 44 is located in the recess structure 52. The first wing plate 44 is connected to the recess structure 52 by a bolt. The first top plate 1 and the second top plate 1 are both provided with the protrusion portions 53 and the recess structures 52. Each two adjacent protrusion portions 53 are connected to same first support rod 17. The two first wing plates 44 are respectively located in two adjacent recess structures 52. That is to say, a junction between each two adjacent top plates 1 is connected to the first support rod 17 or the second support rod 18 to strengthen the connection strength of the two adjacent top plates 1. In addition, there will inevitably be a gap at the junction between each two adjacent top plates 1. The first support rod 17 or the second support rod 18 is connected at the junction to block the gap. When it rains, rainwater enters the first flow channel through the gap and is discharged along the first flow channel, thereby preventing rainwater from seeping into the shed.

As shown in FIGS. 37 to 41, the connecting plate 21 is located at an inner side of the shed, i.e. an inner side of the wallboard 2. Specifically, the connecting plate 21 includes first vertical plate 54, second vertical plate 55, and third vertical plate 56. The third vertical plate 56 is provided between the first vertical plate 54 and the second vertical plate 55. The first vertical plate 54 is connected to the second vertical plate 55 through the third vertical plate 56. The first vertical plate 54 and the second vertical plate 55 are in a same plane. The connecting plate 21 has an inverted U-shaped structure. The first vertical plate 54, the second vertical plate 55, and the third vertical plate 56 are integrally formed, resulting in high production efficiency. The third vertical plate 56 includes two third wing plates and one mounting plate. The two third wing plates are respectively located at two sides of the mounting plate. One third wing plate is connected to the first vertical plate 54, and the other third wing plate is connected to the second vertical plate 55. The two third wing plates and the mounting plate form a second flow channel. The significance of the second flow channel is that even if rainwater seeps into the junction between two wallboards 2, the rainwater will be guided along the second flow channel and discharged from a bottom of the second flow channel, rather than entering the shed. Preferably, if any two adjacent wallboards 2 are defined as a first plate and a second plate, respectively, then after the first plate and the second plate are connected, the first vertical plate 54 is connected to the first plate by a bolt, and the second vertical plate 55 is connected to the second plate by a bolt. A junction between the first plate and the second plate is directly facing the second flow channel, thereby preventing rainwater from entering the shed.

A lower end of the mounting plate is provided with third mounting portion 58. The third mounting portion 58 is a protrusion that extends downwards from the mounting plate. The third mounting portion 58 is inserted into the first limit groove 38. An upper end of the mounting plate is provided with second mounting portion 57. The second mounting portion 57 is connected to the first bottom plate 42 or the second bottom plate 45 by a bolt. Specifically, there is an angle greater than 90° but less than 180° between the second mounting portion 57 and the mounting plate, which facilitates the connection of the second mounting portion 57 to the first bottom plate 42 or the second bottom plate 45 by the bolt. A junction between the second mounting portion 57 and the first bottom plate 42 or the second bottom plate 45 is located at the inner side of the wallboard 2.

As shown in FIGS. 9 to 19, in an embodiment of the present disclosure, the bottom of the wallboard 2 is provided with first positioning protrusion 25. The first positioning protrusion 25 is located at one end of the bottom of the wallboard. First positioning groove 27 is fit with the first positioning protrusion 25 to limit the one end of the bottom of the wallboard 2 to the floor 10. Specifically, the first positioning groove 27 is an arc-shaped groove, allowing the first positioning protrusion 25 to rotate in the first positioning groove 27. Overall, the floor 10 is provided with the first positioning groove 27, the bottom of the wallboard 2 is provided with the first positioning protrusion 25, and the first positioning protrusion 25 is located at one end of the bottom of the wallboard. Therefore, when the shed is mounted, first, the end with the first positioning protrusion 25 is inserted into the first positioning groove 27, and the first positioning protrusion 25 is taken as a fulcrum to rotate or push the wallboard 2, thereby connecting the bottom of the wallboard to the floor 10. That is, during mounting, only a position of the bottom of the wallboard 2 needs to be raised to connect the floor 10, without the need to raise the entire bottom of the wallboard 2, making the mounting labor-saving and convenient. It can be understood that the first positioning groove 27 is located at an outer side of the first limit groove 38, such that the connecting plate 21 is located at the inner side of the wallboard 2.

It should be noted that the first positioning groove 27 includes a first mounting point and a second mounting point. The first mounting point and the second mounting point are interconnected. The bottom of the wallboard 2 is provided with second positioning protrusion 26. The second positioning protrusion 26 is provided at an end far away from the first positioning protrusion 25. Any two adjacent wallboards 2 are defined as a first plate and a second plate. After the first plate and the second plate are connected to the floor 10, the first positioning protrusion 25 of the first plate is located at the first mounting point of previous first positioning groove 27, the second positioning protrusion 26 of the first plate is located at the second mounting point of subsequent first positioning groove 27, the first positioning protrusion 25 of the second plate and the second positioning protrusion 26 of the first plate are located in the same first positioning groove 27, and the first positioning protrusion 25 of the second plate is located at the first mounting point of the first positioning groove 27. In this way, the first positioning groove 27 of the floor 10 can simultaneously achieve the positioning of two adjacent wallboards 2 without the need for an additional positioning groove. Specifically, a height of the first positioning protrusion 25 is defined as H1, and a height of the second positioning protrusion 26 is defined as H2, H2<H1. When the first plate is mounted on the floor 10, the first positioning protrusion 25 of the first plate first enters the previous first positioning groove 27. The first positioning protrusion 25 is taken as a fulcrum to rotate the first plate, such that the second positioning protrusion 26 of the first plate enters the subsequent first positioning groove 27 and is located at the second mounting point of the first positioning groove 27. So far, the first positioning protrusion 25 is located in the previous first positioning groove 27. If the height of the second positioning protrusion 26 is too large, it will be difficult to enter the second mounting point of the subsequent first positioning groove 27 during mounting and difficult to be pulled out from the second mounting point during disassembly.

In an embodiment of the present disclosure, the wallboard 2 includes first support plates 15 and second support plates 16. The first support plate 15 is a plate-like structure, roughly a planar structure. The first support plate 15 is configured for connection at a position of the shed other than at the corner thereof. The second support plate 16 is configured for connection at the corner of the shed. The first support plate 15 is connected to adjacent first support plate 15 or second support plate 16. The second support plate 16 includes first working plate 30 and second working plate 31. The first working plate 30 and the second working plate 31 are able to be connected to the first support plate 15. The first working plate 30 and the second working plate 31 are integrated. A side of the first working plate 30 is connected to a side of the second working plate 31. After the first working plate 30 and the second working plate 31 are connected, an angle between the first working plate 30 and the second working plate 31 is greater than 0° but less than 180°. In other words, the second support plate 16 is located at the corner of the shed, and the angle at the corner can be acute, obtuse, or right. At the corner, the bottom of the wallboard 2 is connected to the floor 10, and the side of the second support plate of the wallboard 2 is connected to adjacent wallboard 2. Therefore, it is easy to form a connecting gap at the corner. In the present disclosure, the second support plate 16 is integrally formed by the first working plate 30 and the second working plate 31, which are mutually angled. There is a high sealing tightness between the first working plate 30 and the second working plate 31, avoiding the connection between the wallboards 2 at the corner. At the corner, it is only necessary to consider the connection between the wallboard 2 and the floor 10. On the one hand, there is no gap at the junction between the first working plate 30 and the second working plate 31, which avoids water seepage and rain leakage, improves the connection tightness of the wallboards at the corner, and ensures the safety and reliability of the shed. On the other hand, this facilitates the assembly and disassembly of the shed. Preferably, after the first working plate 30 and the second working plate 31 are connected, the angle between the first working plate 30 and the second working plate 31 is 90°. That is, the angle at the corner of the wallboard is 90°, which allows for the reasonable utilization of the space inside the shed and avoids space waste.

Two sides of the first support plate 15 are provided with first clamping connectors 24 and first connecting grooves 23, and two sides of the second support plate 16 are provided with second clamping connectors 32 and second connecting grooves 33. The first clamping connectors 24 are fit with the second connecting grooves 33, and the second clamping connectors 32 are fit with the first connecting grooves 23, thereby connecting the first support plate 15 and the second support plate 16. Any two adjacent first support plates 15 are defined as a first plate and a second plate respectively. Then the first clamping connectors 24 of the first plate are fit with the first connecting grooves 23 of the second plate, and the first connecting grooves 23 of the first plate are fit with the first clamping connectors 24 of the second plate, thereby connecting the two adjacent first support plates 15. Each wallboard 2 is provided with clamping connectors and connecting grooves, and the clamping connectors and connecting grooves of each two adjacent wallboards 2 form a double fit, making the connection between the wallboards 2 tight and reliable. The two sides of the first support plate 15 are provided with first protrusions 22. The first protrusions 22 are spaced from the first connecting grooves 23. The first clamping connector 24 is provided on the first protrusion 22. The two sides of the second support plate 16 are provided with second protrusions 34. The second protrusions 34 are spaced from the second connecting grooves 33. The second clamping connector 32 is provided on the second protrusion 34. The first protrusion 22 has a length smaller than a length of the first connecting groove 23 and a length of the second connecting groove 33. The second protrusion 34 has a length smaller than the length of the first connecting groove 23 and the length of the second connecting groove 33. In this way, the first protrusion 22 and the second protrusion 34 are movable up and down in the first connecting groove 23 and the second connecting groove 33 respectively, facilitating the mounting of the wallboard 2.

Figure 18:
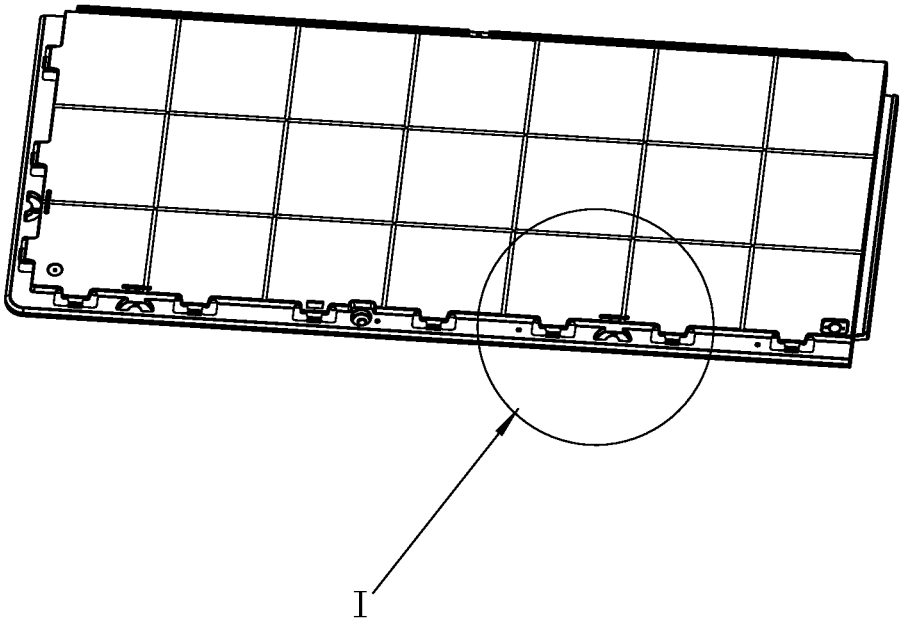
FIG. 18 is a structural diagram of a floor according to the present disclosure.
Figure 19:
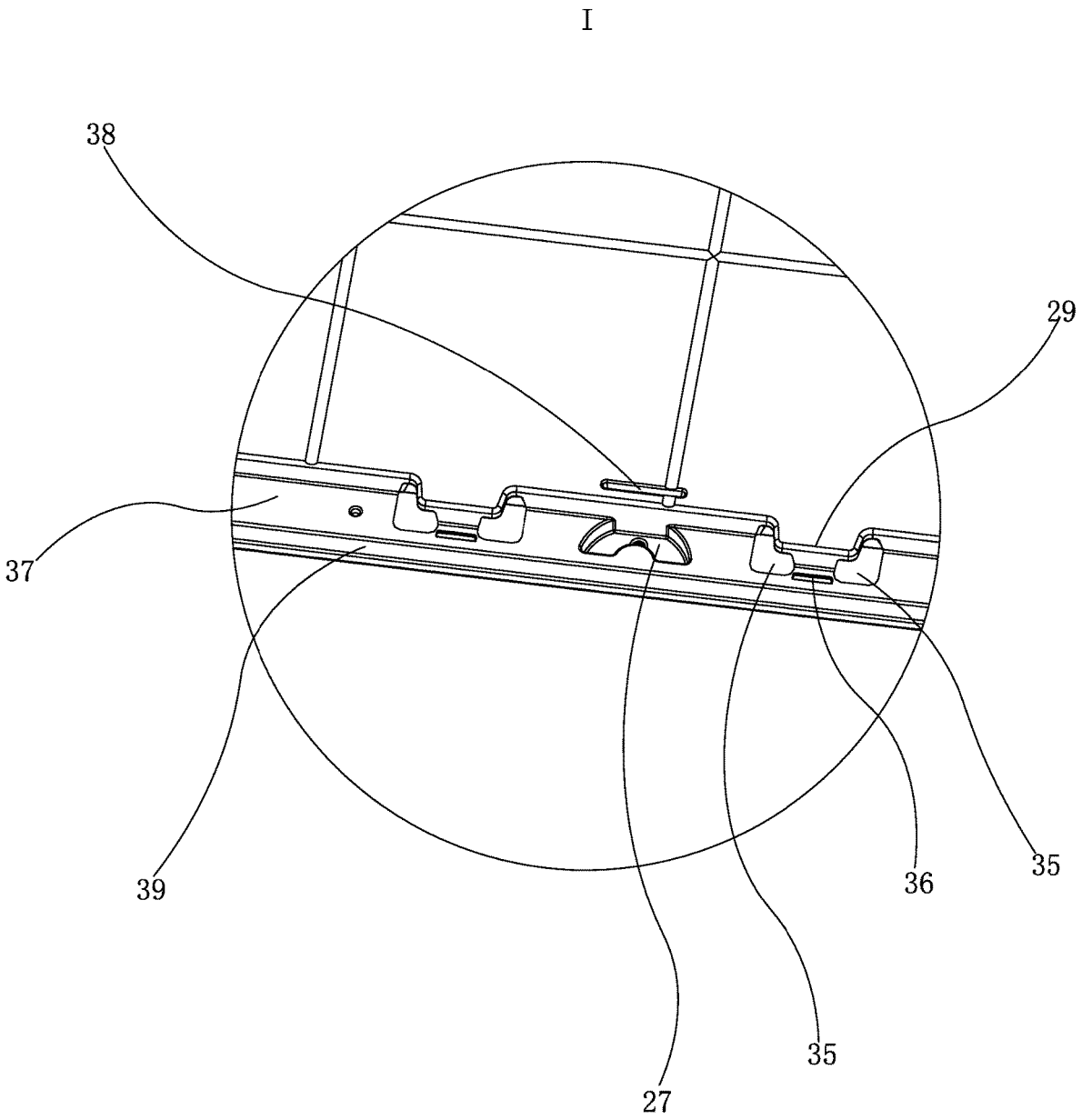
FIG. 19 is an enlarged view of I shown in FIG. 18.
Figure 20:
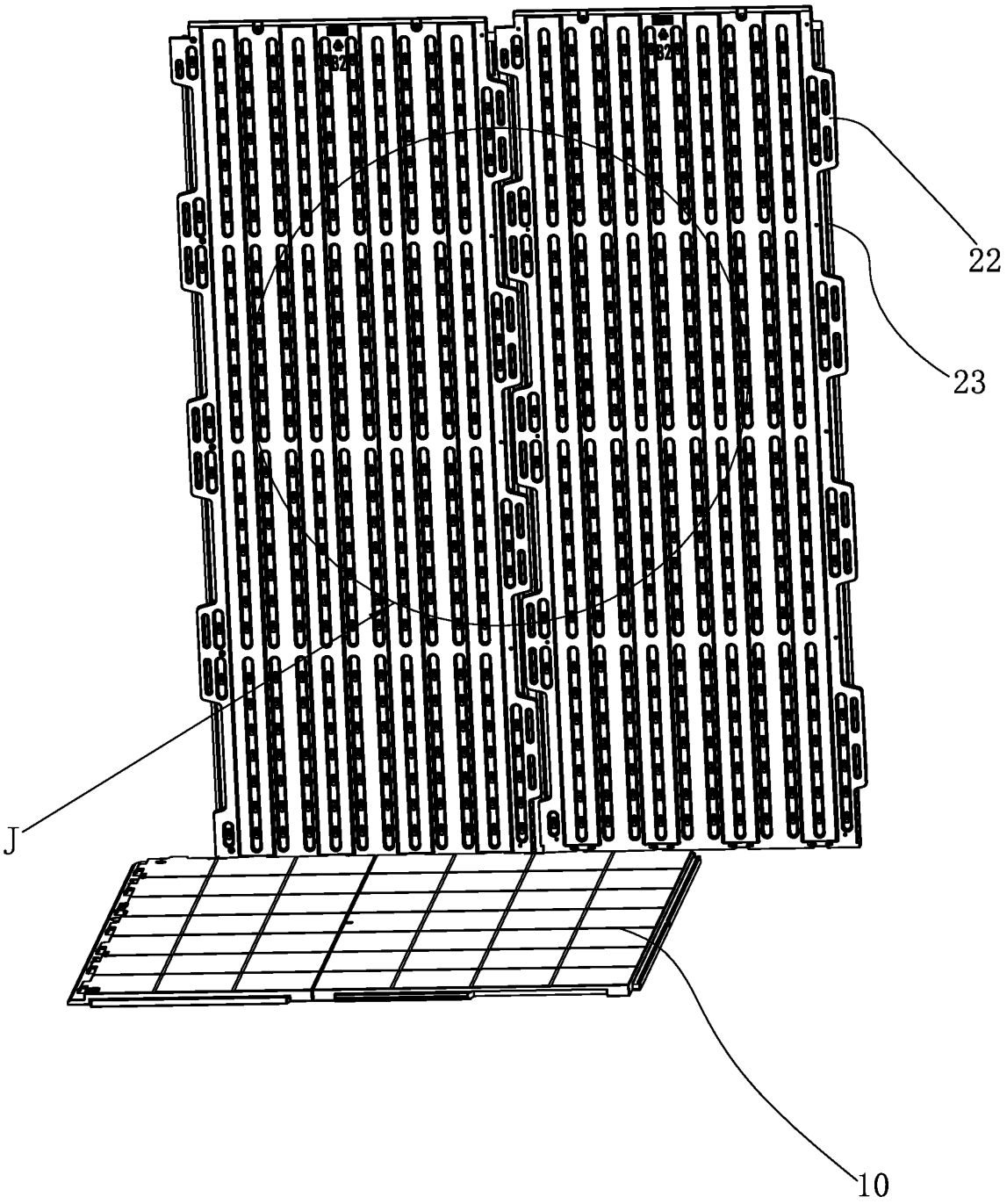
FIG. 20 is a first structural diagram of the wallboard and the floor that are connected according to the present disclosure.
Figure 21:
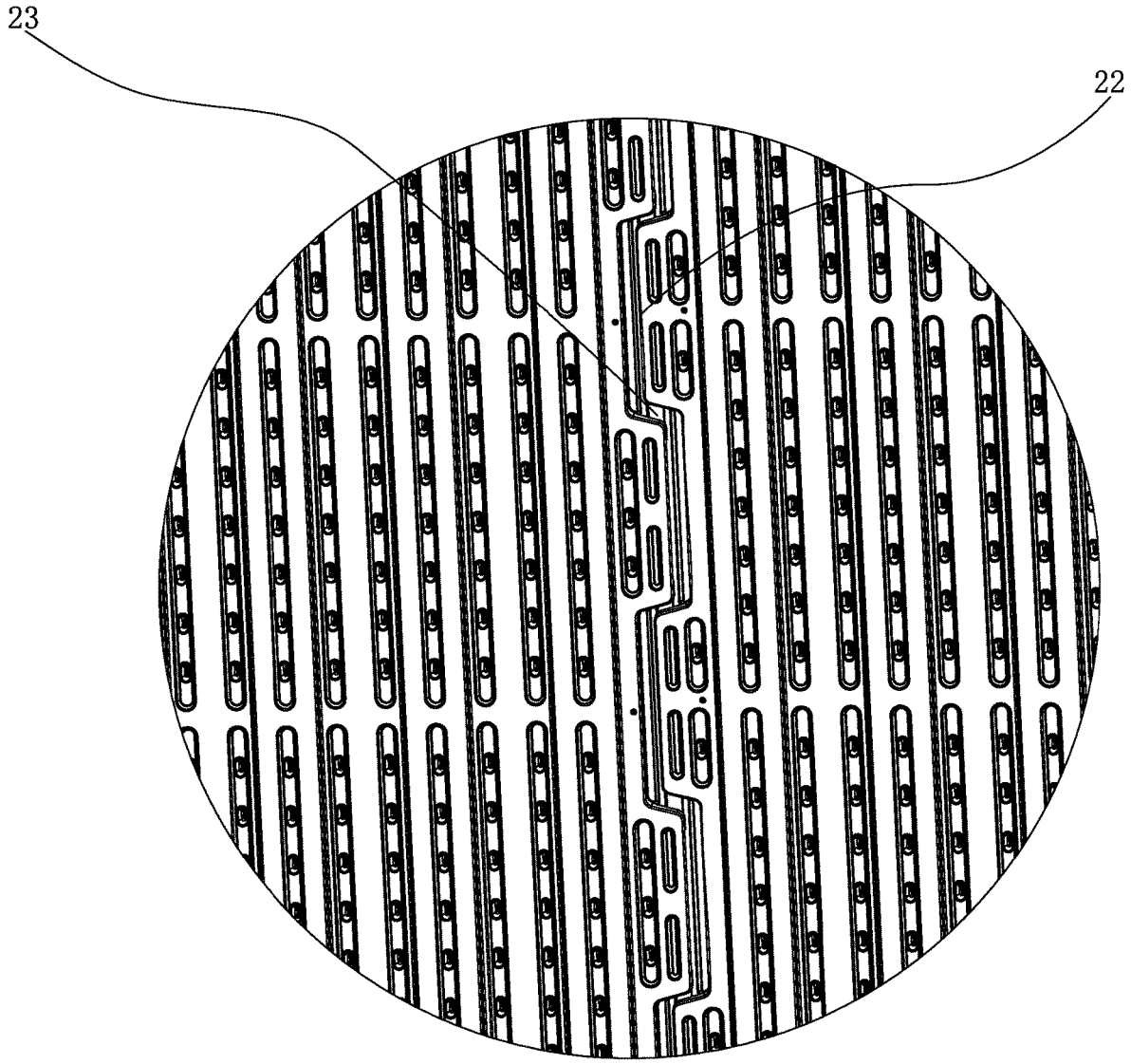
FIG. 21 is an enlarged view of J shown in FIG. 20.
Figure 22:
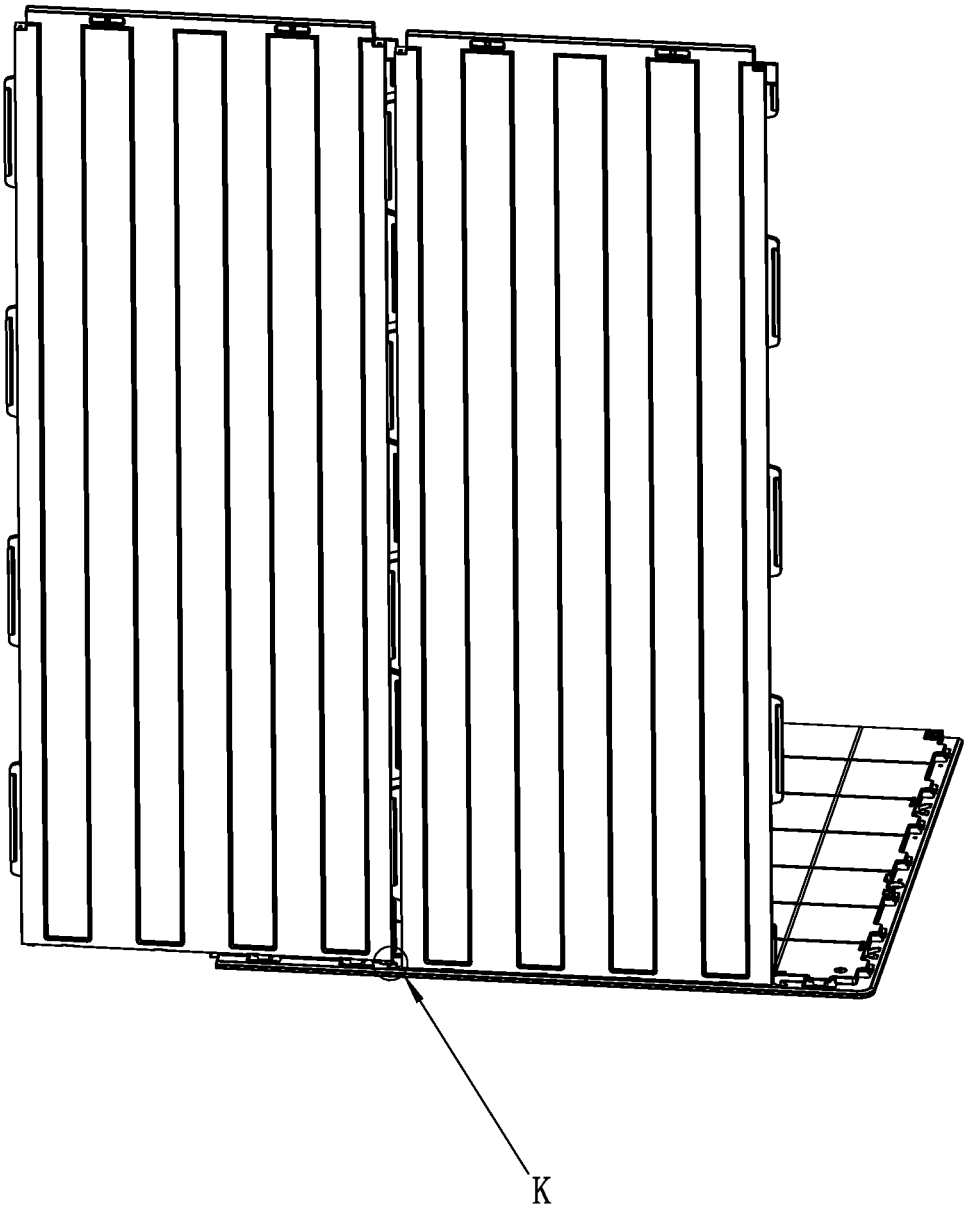
FIG. 22 is a second structural diagram of the wallboard and the floor that are connected according to the present disclosure.
Figure 23:
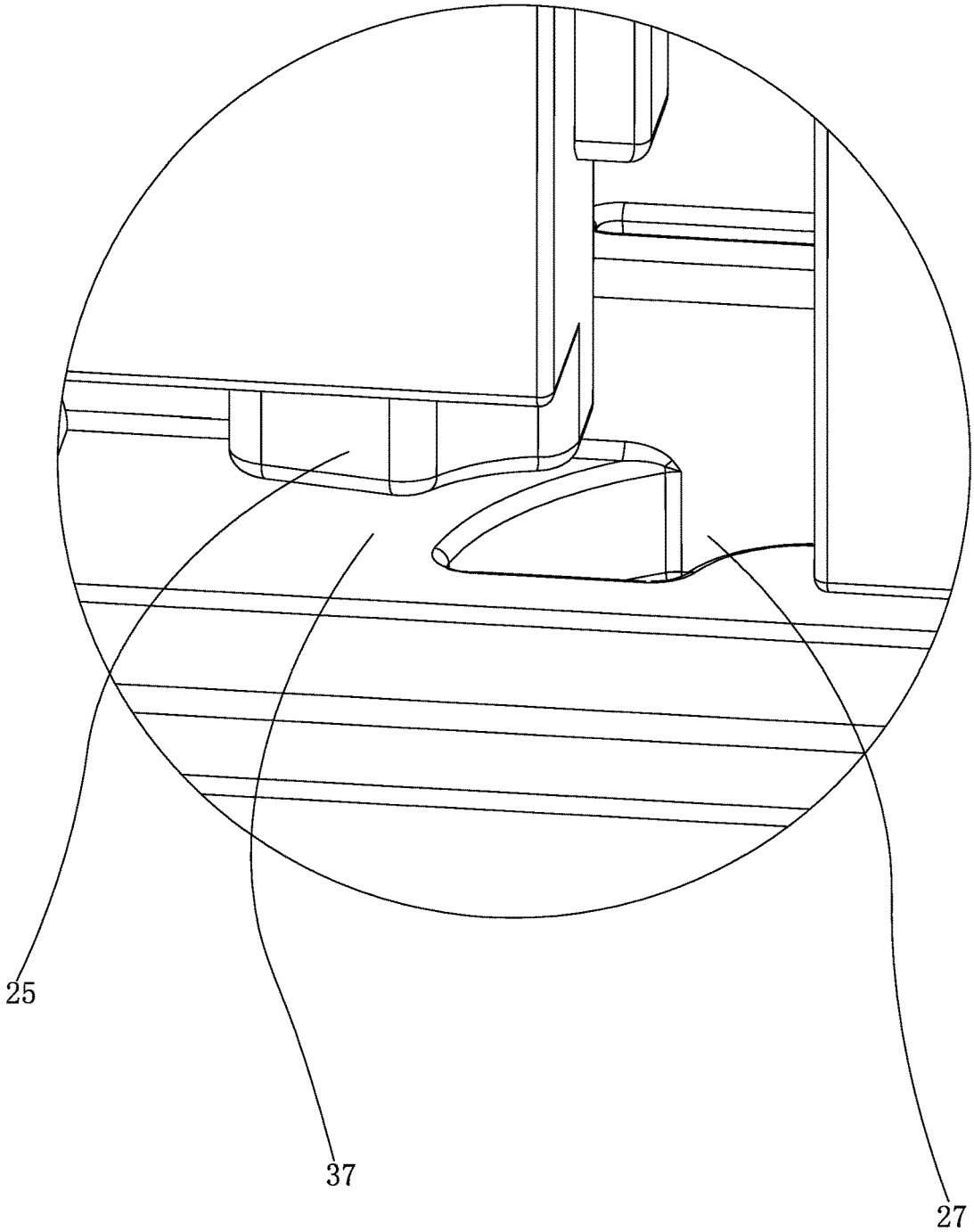
FIG. 23 is an enlarged view of K shown in FIG. 22.

As shown in FIGS. 18 and 19, the floor 10 is provided with multiple first limit protrusions 29. Two sides of the first limit protrusion 29 are provided with hollow parts 35. An inner wall of the wallboard 2 is provided with multiple third recesses 28. The third recesses 28 are T-shaped recesses located at the bottom of the wallboard 2. The first limit protrusions 29 correspond one-to-one with the third recesses 28 in terms of quantity and position. The first limit protrusions 29 are fit with the third recesses 28 in terms of shape. The first limit protrusions 29 are fit with the third recesses 28 to connect the wallboard 2 and the floor 10. The hollow parts 35 are process holes, which are easy to be molded and for stress relief, increasing the elasticity of the floor 10 at this location and making it easy for the first limit protrusions 29 to be inserted into or pulled out of the third recesses 28. The first positioning protrusion 25 at one end of the wallboard 2 is taken as a fulcrum to rotate the other end of the wallboard into the floor 10. At this point, the wallboard 2 is pushed such that the first limit protrusions 29 are inserted into the third recesses 28, thereby connecting the wallboard 2 to the floor 10.

Furthermore, the floor 10 is provided with step surface 37. The first limit protrusion 29 and the first positioning groove 27 are provided on the step surface 37. After the wallboard 2 is connected to the floor 10, the bottom of the wallboard 2 is located on the step surface 37. The step surface 37 is open outward, making it easy to move the wallboard 2 to the floor 10 during mounting. In addition, the step surface 37 has a certain height, so the step surface 37 can prevent water from entering the shed and plays a water-proof role. In order to further strengthen the connection structure between the wallboard 2 and the floor 10, the step surface 37 is provided with multiple protrusions 36, and the bottom of the wallboard 2 is provided with multiple first grooves. The protrusions 36 correspond one-to-one with the first grooves in terms of quantity and position. After the wallboard 2 is connected to the floor 10, the protrusions 36 are located in the first grooves. The protrusions 36 are raised bars or ridges. The protrusions 36 are located close to the first limit protrusions 29, and serve as an auxiliary connection. Preferably, the protrusion 36 is provided with a first slope. The first slope faces an outer side of the step surface 37, such that it is easy for the third recess 28 at the bottom of the wallboard 2 to slide towards the first limit protrusion 29 when the wallboard is pushed, allowing the first limit protrusion 29 to enter the third recess 28, thereby connecting the wallboard 2 to the floor 10.

Particularly, as shown in FIG. 19, in an embodiment of the present disclosure, second slope 39 is provided at an edge of the step surface 37. If the area of the wallboard 2 is too large, it requires a lot of effort to mount the wallboard 2 and the floor 10. The second slope 39 is equivalent to a buffer strip. When the wallboard 2 is mounted, the wallboard 2 can be slid upwards along the second slope 39 to the step surface 37, thereby connecting the wallboard 2 to the floor 10. The second slope 39 achieves labor-saving mounting of the wallboard 2.

Figure 24:
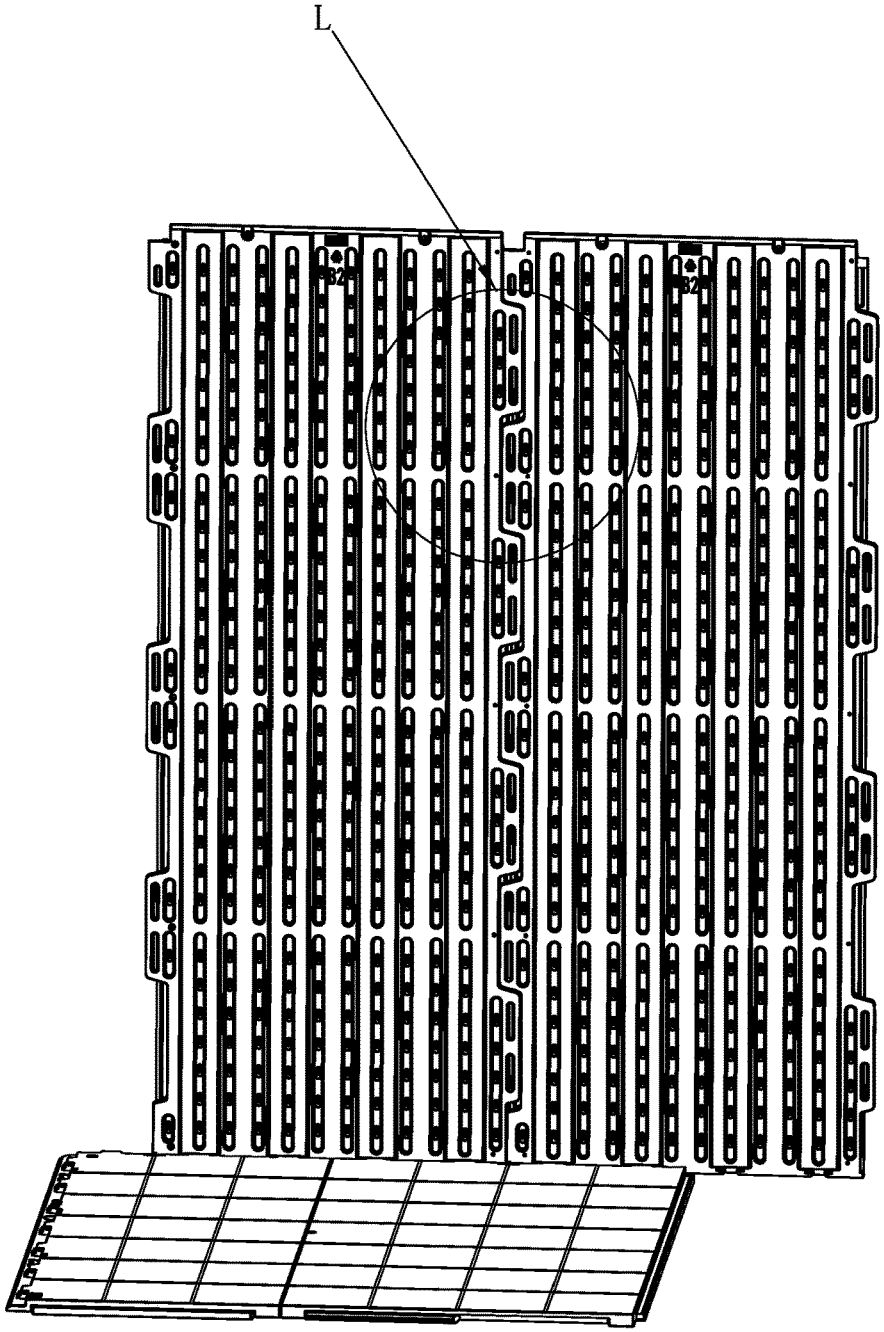
FIG. 24 is a third structural diagram of the wallboard and the floor that are connected according to the present disclosure.
Figure 25:
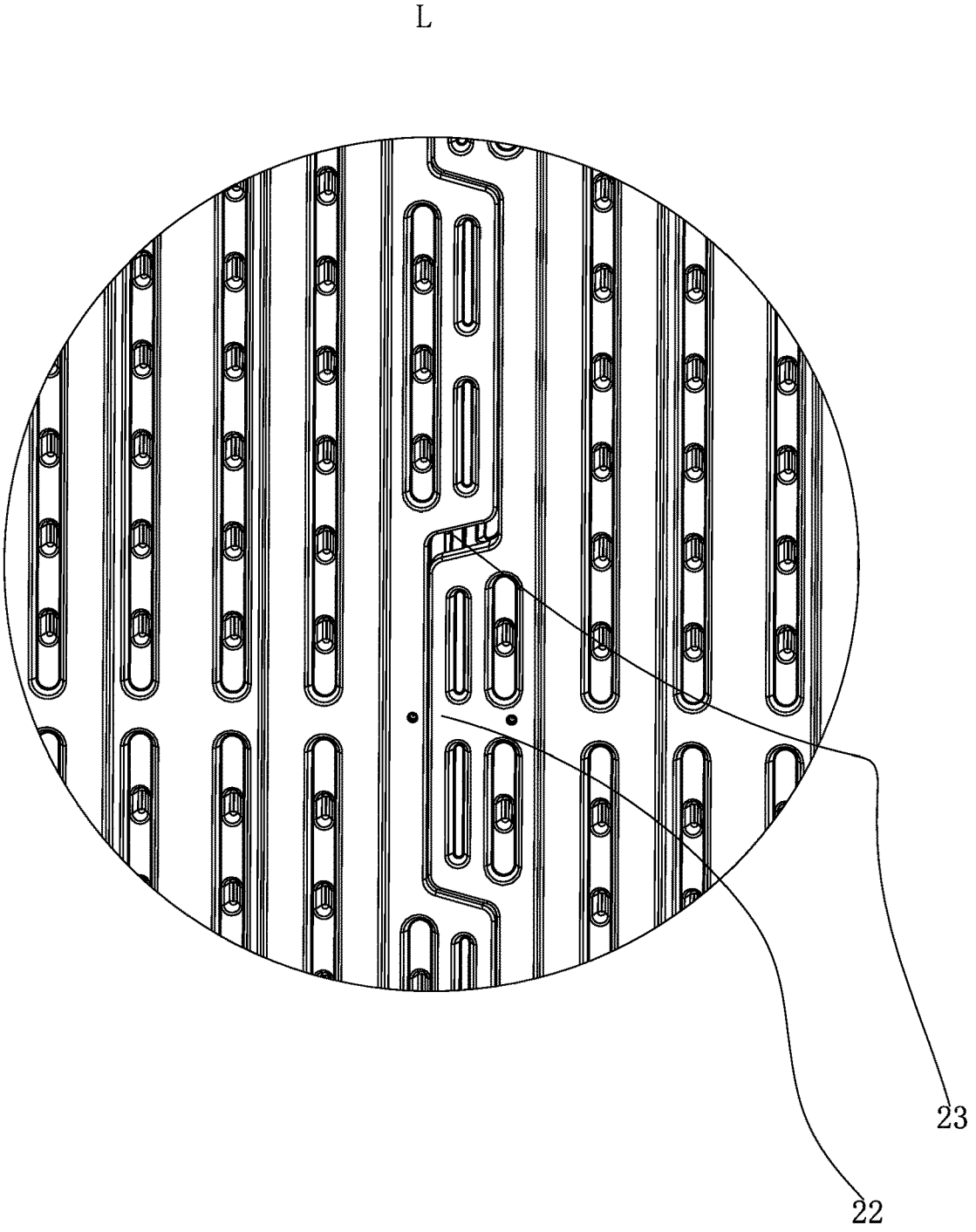
FIG. 25 is an enlarged view of L shown in FIG. 24.
Figure 26:
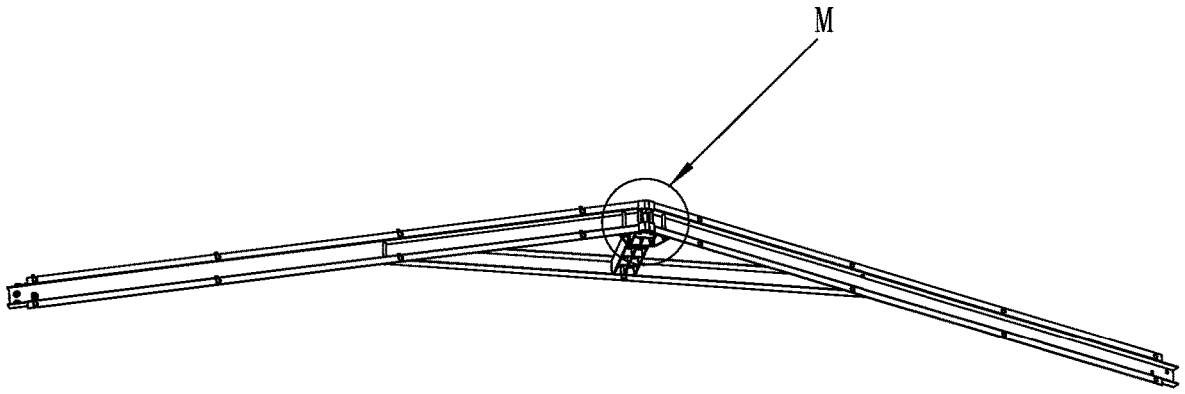
FIG. 26 is a first structural diagram of a support frame according to the present disclosure.
Figure 27:
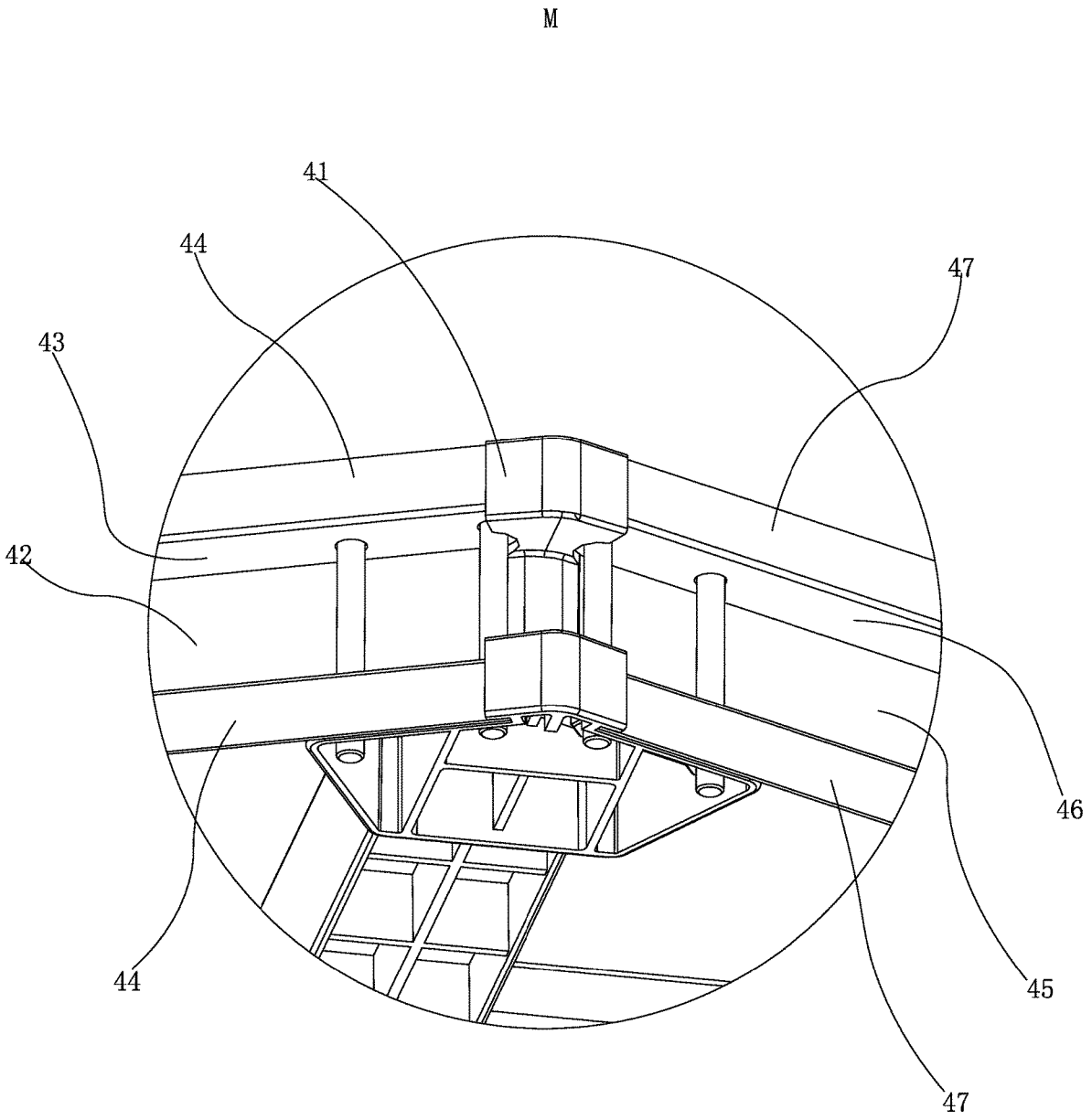
FIG. 27 is an enlarged view of M shown in FIG. 26.
Figure 28:
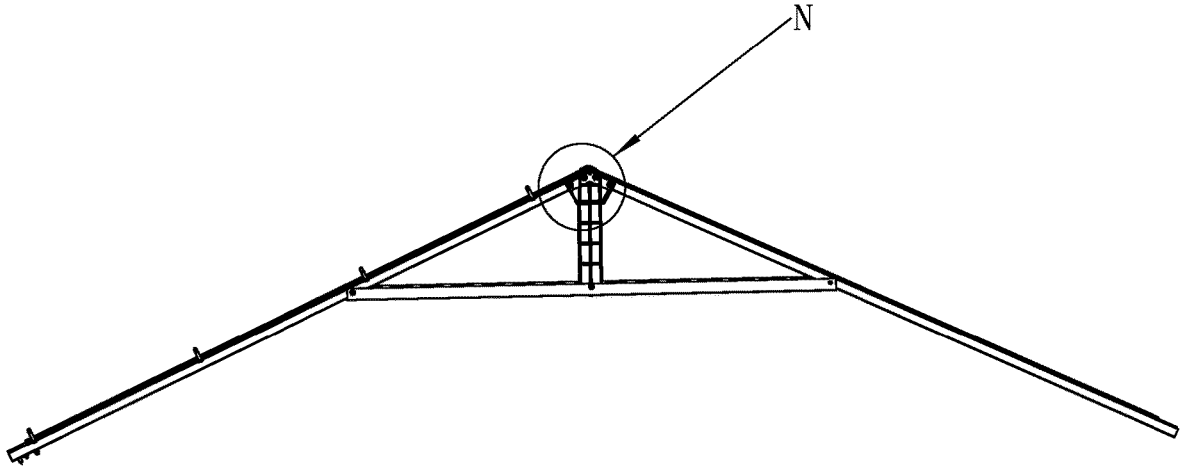
FIG. 28 is a second structural diagram of the support frame according to the present disclosure.
Figure 29:
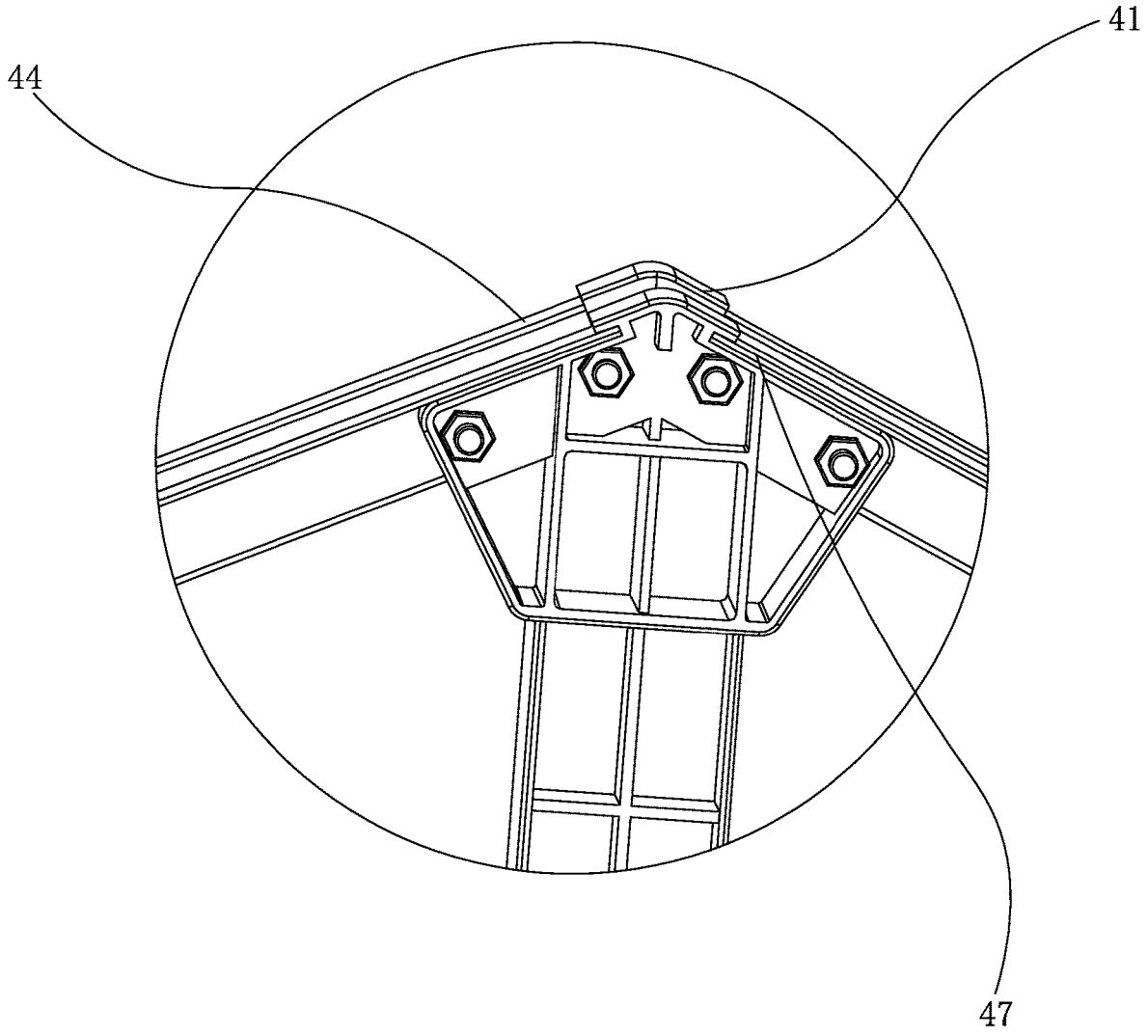
FIG. 29 is an enlarged view of N shown in FIG. 28.
Figure 30:
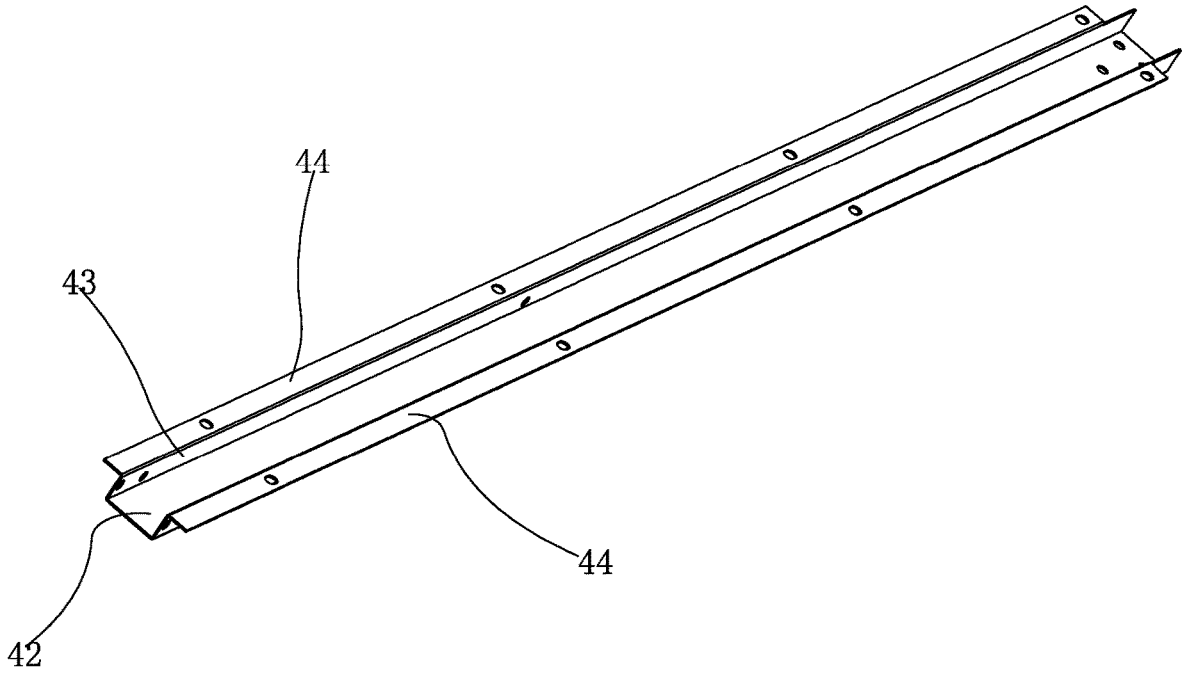
FIG. 30 is a structural diagram of a first support rod according to the present disclosure.
Figure 31:
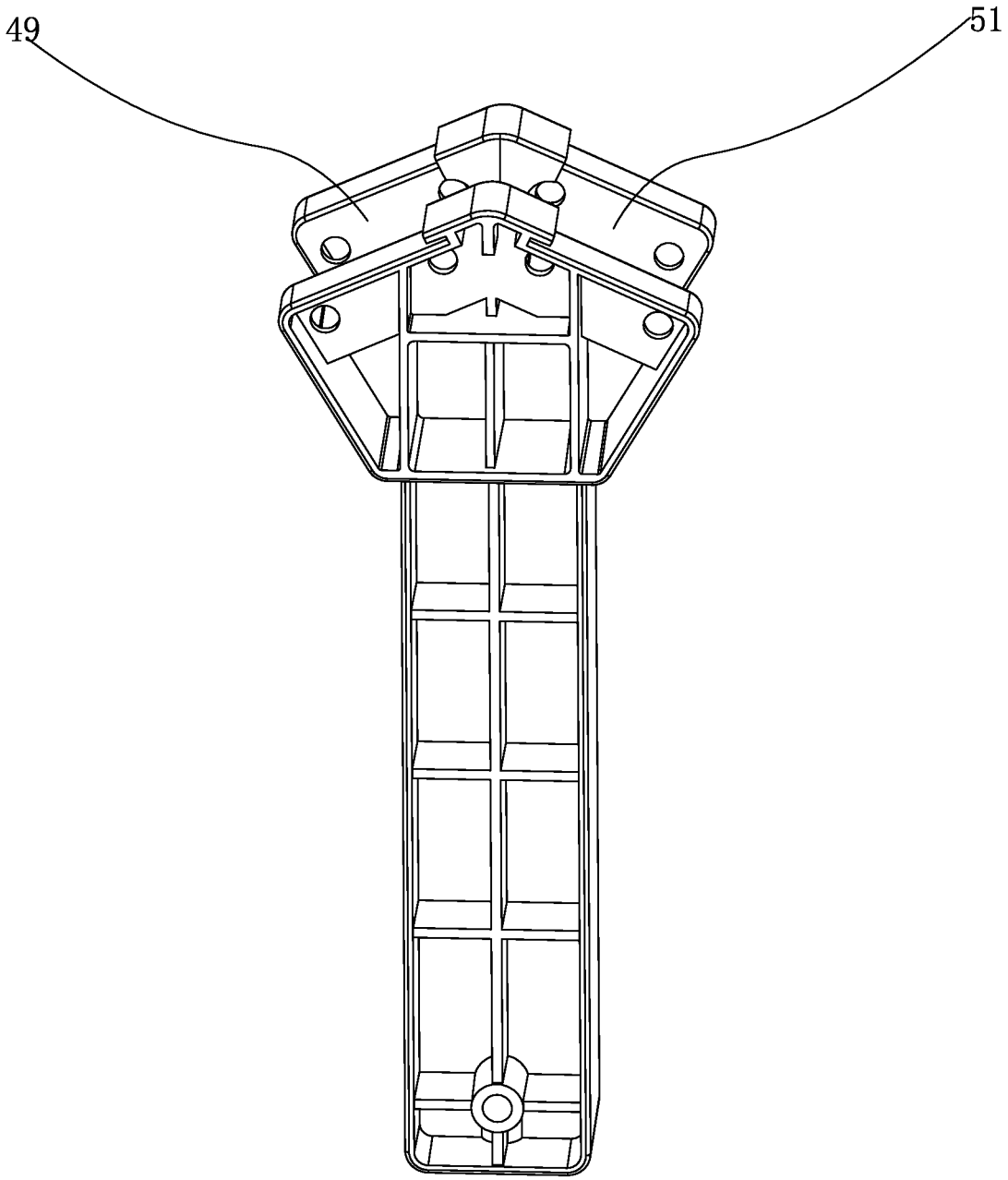
FIG. 31 is a first structural diagram of a mounting bracket according to the present disclosure.
Figure 32:
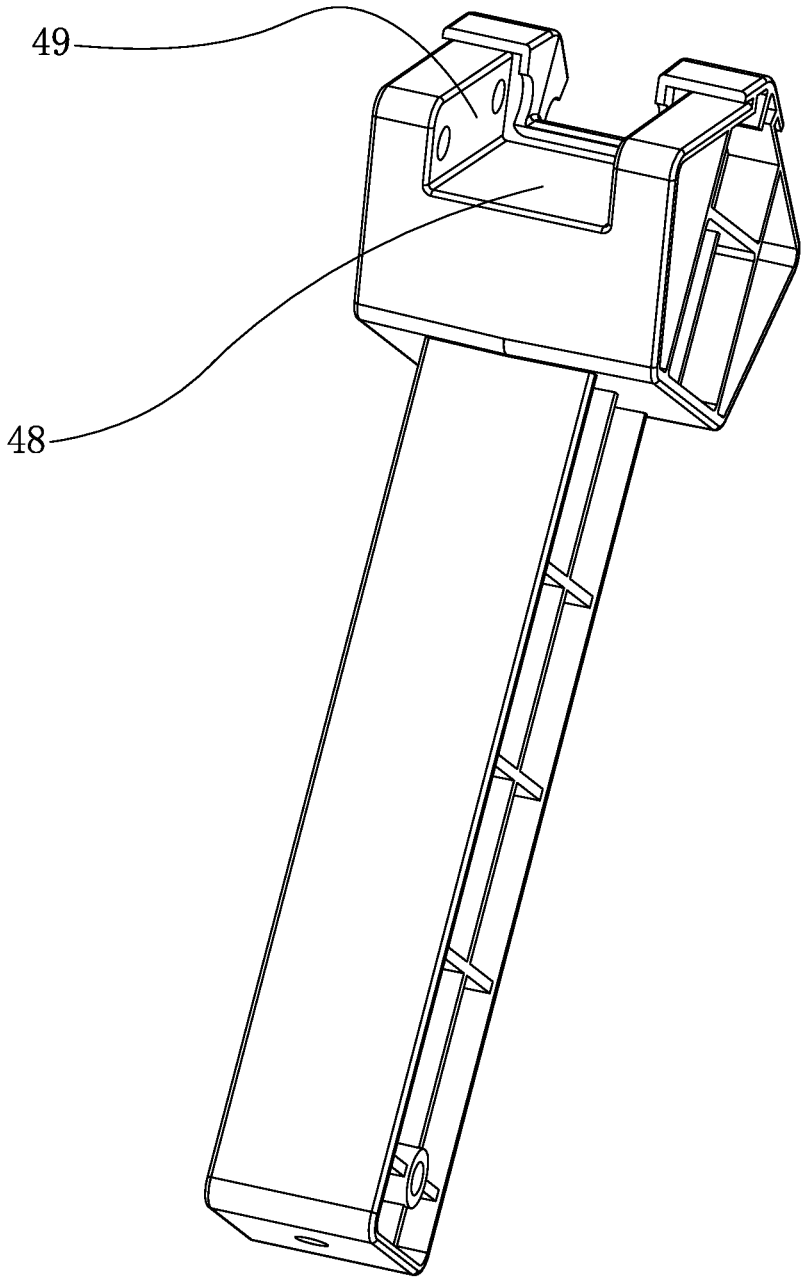
FIG. 32 is a second structural diagram of the mounting bracket according to the present disclosure.
Figure 33:
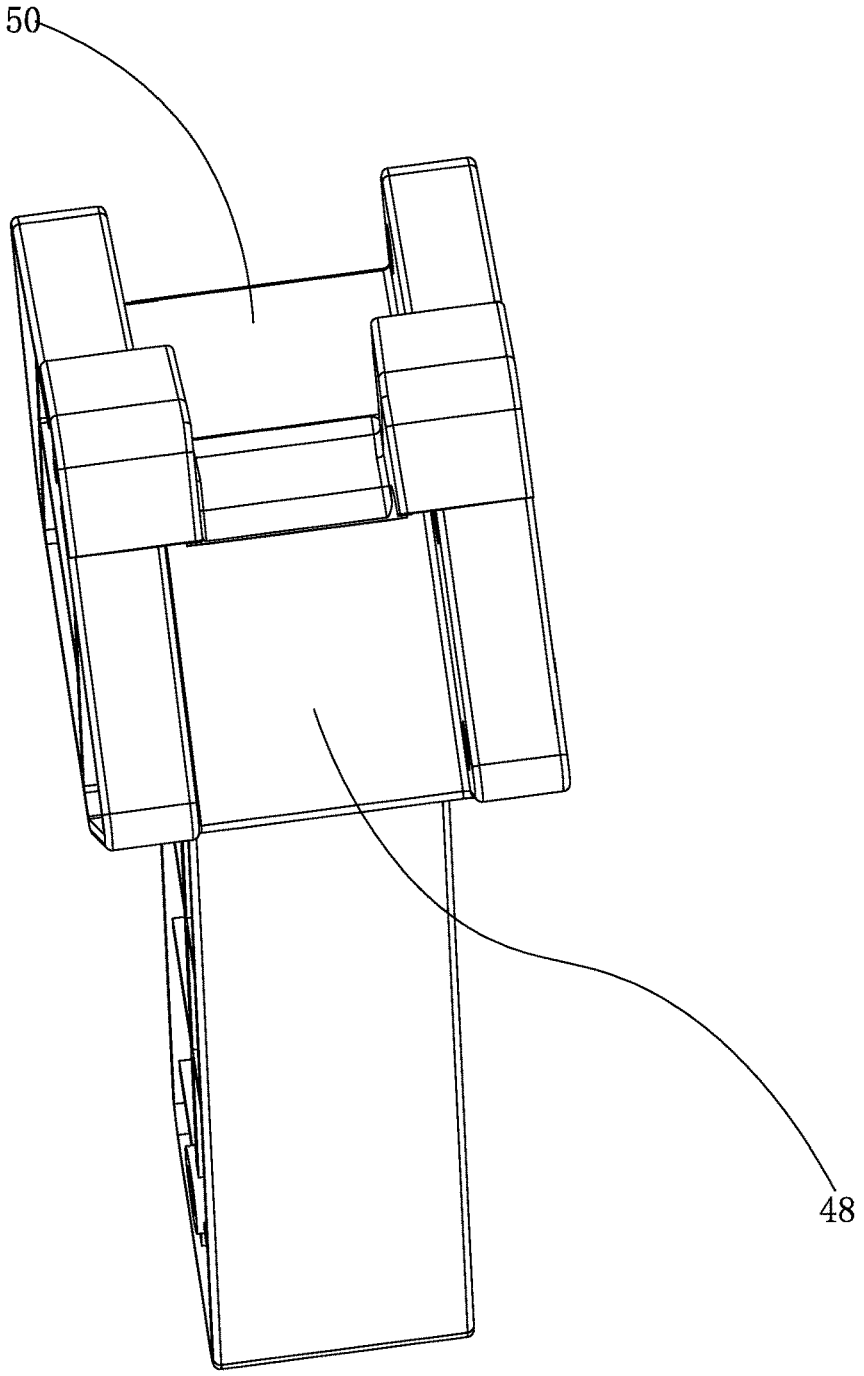
FIG. 33 is a third structural diagram of the mounting bracket according to the present disclosure.

It should be noted that the mounting of the wallboard 2 of the shed starts from two sides (left or right) of a shed door. For example, a first wallboard is provided from the left of the shed door (the first wallboard is provided on the floor 10). First, the end of the wallboard 2 with the first positioning protrusion 25 is moved into the first positioning groove 27. The first positioning protrusion 25 is taken as a fulcrum to rotate or push the wallboard, so as to make the second positioning protrusion 26 at the other end of the bottom of the wallboard fall into the second mounting point of subsequent first positioning groove 27. Thus, the mounting of the first wallboard is completed. Then, second wallboard 2 is provided (here the second wallboard is the first support plate 15). When the second wallboard is provided, first, the second wallboard is moved to the step surface 37, with one side close to the side of the first wallboard with the second positioning protrusion 26. At this point, the first clamping connector 24 of the second wallboard is located at an edge of the first connecting groove 23 of the first wallboard, the first clamping connector 24 of the first wallboard is located at an edge of the first connecting groove 23 of the second wallboard, and the first clamping connector 24 of the second wallboard is at an upper position of the first connecting groove 23 on the first wallboard (as shown in FIGS. 20 to 23). Next, the first positioning protrusion 25 of the second wallboard close to the first wallboard is taken as a fulcrum to rotate or push the second wallboard, such that the first positioning protrusion 25 of the second wallboard falls into the first mounting point of the first positioning groove 27. In other words, the first positioning protrusion 25 of the second wallboard and the second positioning protrusion 26 of the first wallboard are in the same first positioning groove 27. At this point, the first clamping connector 24 of the second wallboard is located at a lower position of the first connecting groove 23 on the first wallboard. Thus, the mounting of the second wallboard is completed (as shown in FIGS. 24 to 25). The subsequent wallboard mounting is similar to the mounting of the second wallboard. Due to the limiting effect of the adjacent wallboard and the floor 10, the connection between the wallboards and between the wallboard 2 and the floor 10 is reliable.

The present disclosure is described in detail above. Specific cases are used herein to illustrate the principle and implementation of the present disclosure, and the description of the above embodiments is only intended to help understand the core idea of the present disclosure. It should be noted that several improvements and modifications may also be made by those of ordinary skill in the art without departing from the principles of the present disclosure, which also fall within the scope of protection claimed by the present disclosure.

What is claimed is:

1. A shed, comprising:

a plurality of top plates, a support frame, and multiple wallboards;

each of the wallboards are provided with a first mounting portion; an end of each top plate is provided with a first mounting groove;

the first mounting portion is engaged with the first mounting groove and connects each top plate to a respective said wallboard;

the top plates comprise multiple first top plates and multiple second top plates;

the first top plates are connected to the second top plates;

the support frame comprises a first support rod and a second support rod;

the first support rod is provided at a junction between the first top plates and the second top plates;

a connecting plate is provided at a junction between each two adjacent said wallboards;

a first end of the connecting plate is connected to a first end of the first support rod and a second end of the first support rod is connected to a first end of the second support rod;

a bottom of each wallboard is connected to a floor; the floor is provided with a first limit groove; and a second end of the connecting plate is positioned in the first limit groove;

the bottom of each wallboard is provided with a first positioning protrusion at one end and a second positioning protrusion and an opposite end thereof;

the floor is provided with first positioning grooves;

the first positioning grooves are engaged with the first positioning protrusions to limit movement of one end of the bottom of each wallboard relative to the floor;

the first positioning grooves are arc-shaped grooves;

the first positioning protrusions are rotatable in the first positioning grooves; and a height of each first positioning protrusion is greater than a height of each second positioning protrusion.

2. The shed according to claim 1, wherein the first mounting portion comprises at least a first mounting surface and a second mounting surface;

the first mounting groove comprises at least a first contact surface and a second contact surface;

after the top plate is connected to the wallboard, the first contact surface is at least partially adhered to the first mounting surface, and the second contact surface is at least partially adhered to the second mounting surface, the first contact surface is close to an edge of the top plate, and an area of contact between the first mounting surface and the first contact surface is greater than an area of contact between the second mounting surface and the second contact surface;

the first mounting groove is an elongated groove;

the first contact surface and the second contact surface are provided on an inner wall of the first mounting groove;

the first contact surface and the second contact surface form two side walls of the first mounting groove, respectively;

a width of the first contact surface is greater than a width of the second contact surface;

the first mounting portion further comprises a third mounting surface;

the third mounting surface is provided between the first mounting surface and the second mounting surface;

the first mounting groove further comprises a third contact surface;

the third contact surface is provided between the first contact surface and the second contact surface;

after the top plate and the wallboard are connected, the third contact surface is at least partially adhered to the third mounting surface;

the first mounting portion further comprises a fourth mounting surface;

the fourth mounting surface is provided between the second mounting surface and the third mounting surface;

a width of the third contact surface is greater than a width of the third mounting surface;

after the top plate and the wallboard are connected, the fourth mounting surface is located below a junction between the second contact surface and the third contact surface; and there is a gap between the fourth mounting surface and the junction.

3. The shed according to claim 1, wherein the first positioning groove comprises a first mounting point and a second mounting point;

the second positioning protrusion is provided at an end far away from the first positioning protrusion; and wherein said two adjacent wallboards are defined as a first wallboard and a second wallboard and are connected to the floor, the first positioning protrusion of the first wallboard is located at the first mounting point of a respective said first positioning groove, the second positioning protrusion of the first wallboard is located at the second mounting point of a respective said first positioning groove, the first positioning protrusion of the second wallboard and the second positioning protrusion of the first wallboard are located in the respective first positioning groove, and the first positioning protrusion of the second wallboard is located at the first mounting point of the respective first positioning groove.

4. The shed according to claim 1, wherein the connecting plate comprises a first vertical plate, a second vertical plate, and a third vertical plate; the third vertical plate is provided between the first vertical plate and the second vertical plate; and the first vertical plate is connected to the second vertical plate through the third vertical plate.

5. The shed according to claim 4, wherein the third vertical plate comprises two third wing plates and one mounting plate;

the two third wing plates are respectively located at two sides of the mounting plate;

one third wing plate is connected to the first vertical plate, and the other third wing plate is connected to the second vertical plate;

the two third wing plates and the mounting plate form a second flow channel;

an upper end of the mounting plate is provided with a second mounting portion;

the second mounting portion is connected to the first bottom plate or a second bottom plate;

a lower end of the mounting plate is provided with a third mounting portion; and the third mounting portion is inserted into the first limit groove.

6. The shed according to claim 1, wherein an angle between the first support rod and the second support rod is greater than 90° but less than 180°;

the support frame further comprises a connecting rod;

the connecting rod comprises one end connected to the first support rod and the other end connected to the second support rod;

the first support rod and the second support rod each are provided with a first flow channel; and the first flow channel is located directly below a junction between two adjacent said top plates.

7. The shed according to claim 6, wherein the connecting rod is provided with a mounting bracket; and the first support rod is connected to the second support rod through the mounting bracket.

8. The shed according to claim 6, wherein the first support rod comprises a first bottom plate;

two sides of the first bottom plate are respectively provided with first side plates;

the first side plates are connected to first wing plates;

recess structures are respectively provided at two sides of each top plate;

an outer side of each of the recess structures is provided with a protrusion portion; and after the top plate is connected to the first support rod, the protrusion portion is located at an inner side of the first side plate, and the first wing plate is located in the recess structure.

* * * * *